US007923935B2

(12) United States Patent
Archenhold et al.

(10) Patent No.: US 7,923,935 B2
(45) Date of Patent: Apr. 12, 2011

(54) ILLUMINATION CONTROL SYSTEM FOR LIGHT EMITTERS

(75) Inventors: Geoffrey Howard Gillet Archenhold, Sutton Coldfield (GB); Keith Anderson, Walsall (GB)

(73) Assignee: Radiant Research Limited (GB)

( * ) Notice: Subject to any disclaimer, the term of this patent is extended or adjusted under 35 U.S.C. 154(b) by 670 days.

(21) Appl. No.: 11/912,098

(22) PCT Filed: Apr. 21, 2005

(86) PCT No.: PCT/GB2005/001526

§ 371 (c)(1),
(2), (4) Date: Oct. 19, 2007

(87) PCT Pub. No.: WO2006/111689

PCT Pub. Date: Oct. 26, 2006

(65) Prior Publication Data

US 2008/0191631 A1 Aug. 14, 2008

(51) Int. Cl.
*H05B 37/02* (2006.01)
*G05F 1/00* (2006.01)

(52) U.S. Cl. ..... 315/158; 315/291

(58) Field of Classification Search ..... 315/158, 315/291, 307; 362/551, 555, 558, 240, 241, 362/243

See application file for complete search history.

(56) References Cited

U.S. PATENT DOCUMENTS

| | | | | |
|---|---|---|---|---|
| 5,783,909 | A * | 7/1998 | Hochstein | 315/159 |
| 6,036,328 | A * | 3/2000 | Ohtsuki et al. | 362/612 |
| 6,415,531 | B1 * | 7/2002 | Ohtsuki et al. | 36/31 |
| 6,445,139 | B1 * | 9/2002 | Marshall et al. | 315/291 |
| 6,781,647 | B2 * | 8/2004 | Fujieda | 349/61 |
| 6,848,820 | B2 * | 2/2005 | Natsume | 362/545 |
| 2001/0024112 | A1 | 9/2001 | Jacobs et al. | |
| 2004/0113044 | A1 * | 6/2004 | Ishiguchi | 250/205 |

FOREIGN PATENT DOCUMENTS

| | | | |
|---|---|---|---|
| EP | 1156271 | A1 | 11/2001 |
| GB | 2097909 | A | 11/1982 |

* cited by examiner

*Primary Examiner* — Douglas W Owens
*Assistant Examiner* — Minh D A
(74) *Attorney, Agent, or Firm* — Polster, Lieder, Woodruff & Lucchesi, L.C.

(57) ABSTRACT

A lighting fixture (1010) has a fluorescent tube (1012) and a plurality of emitters (1022-1032). A color sensor (1016) detects light that has been totally internally reflected within a diffuser (1014) and provides a color feedback signal to a feedback control circuit (1020) to control the light output from the fixture (1012).

19 Claims, 27 Drawing Sheets

(a)

(b)

(a)

(b)

(b)

(a)

(a)

(b)

(a)

(b)

| | | | |
|---|---|---|---|
| R | Red | P | Purple |
| B | Blue | O | Orange |
| G | Green | Pk | Pink |
| Y | Yellow | | |
| Lower Case: | "ish" takes suffix | | |

Illuminant A
(x,y) = (0.4476, 0.4074)
(Incandescent source, T=2856K)

Illuminant B
(x,y) = (0.3484, 0.3516)
(Direct sunlight, T=4870K)

Illuminant C
(x,y) = (0.3101, 0.3162)
(Overcast source, T=2856K)

Illuminant D
(x,y) = (0.3128, 0.3292)
(Daylight, T=6504K)

(a)

(b)

ILLUMINATION CONTROL SYSTEM FOR LIGHT EMITTERS

CROSS REFERENCE TO RELATED APPLICATIONS

The present application, as a National Stage filing, derives and claims priority from PCT/GB2005/0015260 having an international filing date of Apr. 21, 2005, published as International Publication No. WO 2006/111689 A1 which is herein incorporated by reference.

BACKGROUND OF THE INVENTION

The present invention relates to an illumination control system for Light Emitters such as Light Emitting Diodes (LEDs), to lighting fixtures embodying such control and to methods of controlling Light Emitters.

The present applicant's earlier application WO 03/022009 (the contents of which are incorporated herein by reference) addresses, inter alia, an issue of colour coordination when multiple light sources at different wavelengths are combined to provide a composite output. Driving multiple light sources, such as LEDs, using Pulse Amplitude Modulation (PAM) provides appreciable advantages over alternative techniques such as Pulse Width Modulation (PWM) and Pulse Frequency Modulation (PFM)

The present invention provides a number of enhancements to the disclosures therein.

A first aspect of the present invention addresses the problem of how to obtain a feedback signal for an optical sensor from a plurality of light emitters.

In accordance with the first aspect a lighting fixture is provided comprising a plurality of light emitters whose light, in operation, passes through a cover and an optical sensor arranged to detect light that has been totally internally reflected in the cover.

The cover may be a lens, diffuser, scatterer or simply a protective layer of glass, plastic or any other suitable transparent or translucent material. The light that is totally internally reflected within the cover is a representative sample in terms of colour and intensity of the light passing through the cover. By arranging an optical sensor to capture some of this light, an effective optical feedback loop may be formed.

The term light used herein is intended to include light having a range of wavelengths e.g. in the visible part of the spectrum as well light having a specific wavelength e.g. photons and is to be construed accordingly.

Preferably, the light emitters comprise LEDs. The optical sensor may detect any suitable characteristic of the light reflected in the cover, for example the optical sensor may comprise a colour sensor and/or an amplitude (intensity) sensor.

Preferably, a feedback circuit is provided responsive to the output of the optical sensor to control the plurality of emitters. For example, to allow change and the control of correlated colour temperature (CCT) and colour rendering index (CRI).

Preferably, the arrangement of the sensor and feedback circuit is such that the lighting fixture automatically complies and maintains control of intensity and/or colour output of the plurality of emitters in accordance to predetermined characteristics.

Preferably, the plurality of light emitters include at least two different types, for example LEDs having a different characteristic wavelength (colour) or a different form such as organic and inorganic LEDs.

Preferably, the plurality of light emitters comprise at least one or more phosphor-light emitting diode(s) that emit a broadband visible spectral wavelength and at least one or more light emitting diode(s) that emit substantially monochromatic light within different wavelengths. This is beneficial for correlated colour temperature (CCT) and colour rendering index (CRI).

Preferably, a control circuit is provided comprising means for driving the two different types of LEDs to desired light intensities during coincident drive periods.

Preferably, means is provided to alter at least one of duration and repetition frequency of the drive period, for example the drive periods may start in response to an external signal.

Preferably, a drive circuit is provided for the plurality of LEDs, the drive circuit comprising power control means for controlling the amount of power supplied to at least one LED, means for measuring the intensity of the light emitted by the at least one LED, the power control means being responsive to the intensity of the light emitted wherein the power control means is arranged to drive the at least one LED at a power greater than specified.

Preferably, a temperature sensor is mounted in proximity to an LED to track the junction temperature thereof and a feedback circuit is preferably provided for ensuring that the power supplied to the LED is, at least in part, responsive to the junction temperature thereof. The temperature sensor may be mounted in the same package as the LED.

Preferably, a lighting control circuit is provided for intermittently driving the plurality of light emitters and receiving feedback information from at least one feedback sensor, the control circuit comprising means for ameliorating transient effects on the output of the feedback sensor, for example an averaging circuit.

Preferably, the means for eliminating transient effects include a delay between the actuation of at least one of the plurality of light emitters and the receiving of feedback information from the at least one feedback sensor.

Preferably, a lighting control circuit is provided for driving at least one LED and for receiving colour information from the optical sensor, the sensor being located to receive light from at least one other light source which does not comprise an LED, the control unit comprising means for driving the at least one LED in response to the colour information received from the sensor regarding the light from the at least another light source.

Preferably, the means for driving the at least one LED are further responsive to colour information received from the sensor which colour information is derived from light generated by both the at least one LED and the at least one other light source.

Preferably, the other light source is a fluorescent light source but other types of light sources may be employed for example, an incandescent light source, a high intensity discharge light source, a tungsten light source, a sodium light source, a metal halide light source and any other suitable light source.

Preferably, at least one or more thermoelectric cooling device(s) is provided to modulate the junction temperature(s) of the light emitting diodes and a microprocessor, field programmable gate array (FPGA) or digital signal processor (DSP) or an electronic logic circuit (ELC) adapted to control said thermoelectric cooling device(s).

Preferably, a current feedback monitor is provided for monitoring and correcting the current driving the thermoelectric cooling device(s) in response to the monitored condition(s).

Preferably, said at least one thermoelectric cooling device is a solid-state heat pump of the Peltier-effect type or a combined heat sink and electric fan unit.

Preferably, a light shaping diffuser is positioned to spatially arrange the light output of the illumination system and to provide a defined beam output that is spatially invariant in colour, colour temperature and colour rendering index properties.

Preferably, a multi-element light emitting diode beam collimating system is provided to convert wide beam angle light emitting diodes to narrow beam angle light sources.

Preferably, the multi-element beam-collimating system contains at least one non-imaging optic, preferably a micro-diffractive non-imaging optic, and at least one imaging optic for light emitting beam collimation.

Preferably, the collimated LED beam is combined with an adjustable multi-element lens system to allow the projection of images through an aperture wherein the outgoing beam angle can be adjusted. Preferably, more than two optical lens are employed. Preferably the collimated LED beam comprises a plurality of synchronised pulsed LED light sources.

Preferably, a data connection interface such as a TCP/IP type controller is provided enabling the fixture to be controlled through a standard computer network and the Internet.

A second aspect of the present invention permits sophisticated control based on ambient light conditions to be effected with little or no increase in component count compared with comparable approaches.

According to a second aspect of the invention, there is provided a lighting control circuit for pulsed driving of a plurality of light emitters and receiving optical output information from at least one optical sensor, the control circuit comprising means for receiving information concerning the light output of the light emitters while at least one of the light emitters is actuated and for receiving information concerning ambient light output when none of the light emitters are activated.

By the second aspect of the present invention, an optical sensor is arranged so that it detects both light issuing from the light emitters and also ambient light. The fact that, when using synchronized pulsed driving, there are OFF periods in which no light is produced by the light emitters means that the same sensor can be read during this period to provide an ambient reading. Control circuitry may then exploit this extra information to effect the control of the light emitters. This may be of particular relevance in the automotive field where collisions are particularly common at dawn and dusk. By factoring in the ambient light conditions, the control circuitry may be arranged to provide a safer environment for the driver.

Preferably the circuit further comprises a feedback circuit for controlling the drive to the plurality of light emitters in response to the actuated light output and ambient light output.

According to a third aspect of the invention, there is provided a lighting control circuit for driving at least two optical emitters having different wavelength characteristics and for receiving a signal from a sensor which sensor can detect wavelength information, the control circuit comprising means for altering the amount of drive applied to the at least two optical emitters in response to colour information derived from the sensor.

Preferably, the one or more sensors consist of a plurality of Silicon PIN diodes with appropriate wavelength filters or a plurality of organic light detectors with appropriate wavelength filters or a spectrometer or a solid-state colour camera detector.

Preferably, the one or more sensors consist of a device that efficiently converts photon energy into electrical energy at predefined wavelength intervals. For example, the photon energy may be converted into electrical energy that represents one of two states, either to provide the electrical energy of the sensor as a representation of the photon energy seen by the human eye, or a representation of the true optical power.

A fourth aspect of the present invention addresses a problem of limited operating range. It is well known that LEDs are non-linear devices and if they are driven at too low a voltage they will, at best, be somewhat inefficient in terms of light output per electrical power input and at worst will fail to generate any light at all.

The fourth aspect of the present invention addresses this by providing synchronised driving waveforms in which at least one additional operating regime is added to the operating range. In this regime the period and/or the mark-space ratio of the pulse driving signal is altered from that used in a pure PAM regime.

A fifth aspect of the invention addresses applications in which a minimum light output is required. Once such application is automotive lighting in which the minimum light output will typically be specified by the relevant regulatory body. A difficulty arises where the light output deteriorates over time such as is the case with LEDs. (Compare this with the catastrophic failure that occurs when filament lamps reach the end of their lives). Because the deterioration of light output will be gradual it will probably not be discernible to the user, or in the case of the car, a driver. While the diminished light output will be detectable at a roadworthiness test station using special equipment, such tests are typically not conducted very frequently and so a considerable period of time could elapse without a driver realising that his or her lamps are dimmer than they ought to be.

According to the fifth aspect of the present invention there is provided a drive circuit for at least one LED which also has means for receiving an intensity measurement of the light emitted by at least one LED. By driving the LED or LEDs in a fixture to higher and higher currents (beyond the recommended values specified by the manufacturer) the light output will be maintained at an acceptable intensity beyond the period of useful life of the LED or fixture. In addition, the increased power supply to the LED will eventually cause thermally-induced failure and it will then be clear that the LED or fixture needs replacing. This aspect of the invention, therefore, not only extends the useful life of an LED or LED fixture but also ensure that the LED or fixture are replaced in a timely fashion.

A sixth aspect of the invention provides enhanced thermal feedback. In the applicant's previous patent application, WO 03/022009, temperature sensors are disclosed for the purpose of measuring ambient temperature. However, the inventors have now come to appreciate that it is also important to measure the junction temperature of the LED. In high-power and high-efficiency LED lighting systems the junction temperature is an important control parameter. However, measurement of the junction temperature directly has not hitherto been possible.

According to the sixth aspect, a temperature sensor is provided in sufficient proximity to the LED billet to track the junction temperature thereof. The present inventors have discovered that by mounting a temperature sensor sufficiently close to the LED billet (possibly even within the same housing) the detected temperature is found to track the junction temperature with a negative offset of around 5° C. over the temperature range of interest.

A seventh aspect of the present invention is concerned with improving the quality of the feedback signals in the closed loop control circuits for light emitters. Particularly in noisy environments and as drive pulses become shorter, there is a danger that feedback signals, be they current feedback, temperature feedback or optical feedback, will be corrupted by transient effects.

This is addressed, in accordance with the seventh aspect, by sampling at a given delay and/or integrating (low pass filtering) the feedback signal prior to feeding the signal to the control circuitry.

According to an eighth aspect of the present invention a wavelength or colour detector is provided to sample the combined output of at least two different LEDs having different wavelengths, the drive to the at least two LEDs being responsive to the output of the detector. One possible arrangement is that at least two LEDs comprise a white phosphor-based LED and a monochromatic LED.

According to a ninth aspect of the present invention an LED compensation system is provided for another type of light emitter such as a fluorescent tube. By sensing the colour of the output of the tube (and preferably the colour of the light from the tube and LEDs combined), control of, inter alia, colour temperature may be effected. This may be used to compensate for aging and/or to customise the characteristics of a fluorescent (or other) fitting.

According to a tenth aspect of the present invention a lighting system is provided comprising at least one LED light source and a collimating system to produce a collimated light output from said at least one LED light source.

The collimating system may comprise a light shaping diffuser. The light shaping diffuser may be combined with a multi-element micro-refractive optic.

In another arrangement, the collimating system may comprise a non-imaging element and an imaging element. The non-imaging element could consist of a micro-diffractive optical system or a holographic optical element.

The collimated light output may be employed in a light projection system to provide a projected image of an aperture or object placed at the aperture.

According to an eleventh aspect of the present invention a lighting control system is provided in which a controller is utilized to control one or more remote lighting fixtures via a data connection interface.

According to a twelfth aspect of the present invention apparatus comprising a plurality of light sources, preferably synchronized collimated LED light sources, combined with an adjustable multi-element lens system capable of varying the outgoing beam angle.

Preferably, the apparatus can be employed in a projection system for the projection of images through an aperture.

The various aspect of the present invention will now be described, by way of example, with reference to the accompanying drawings in which.

Figure 12:
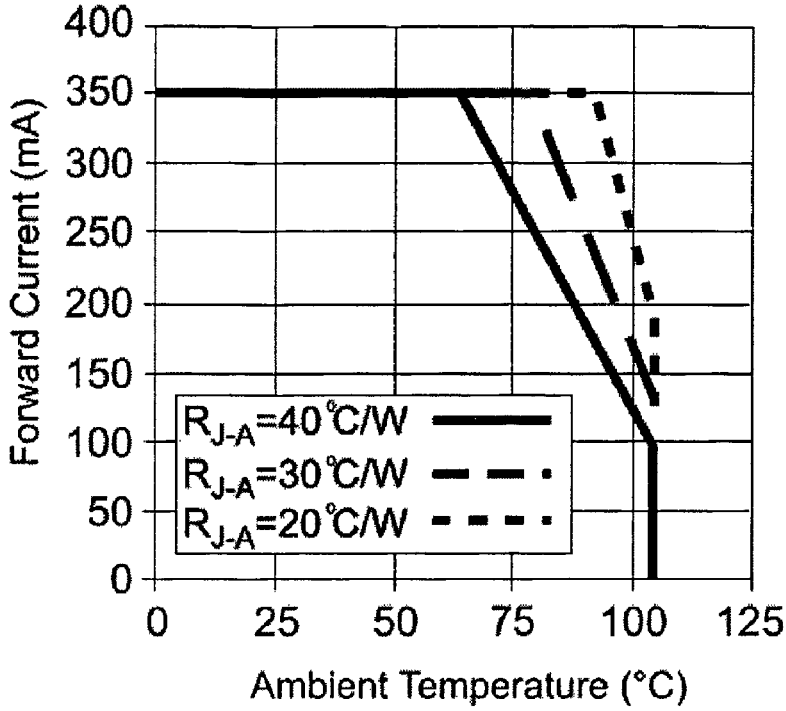
Figure 12:
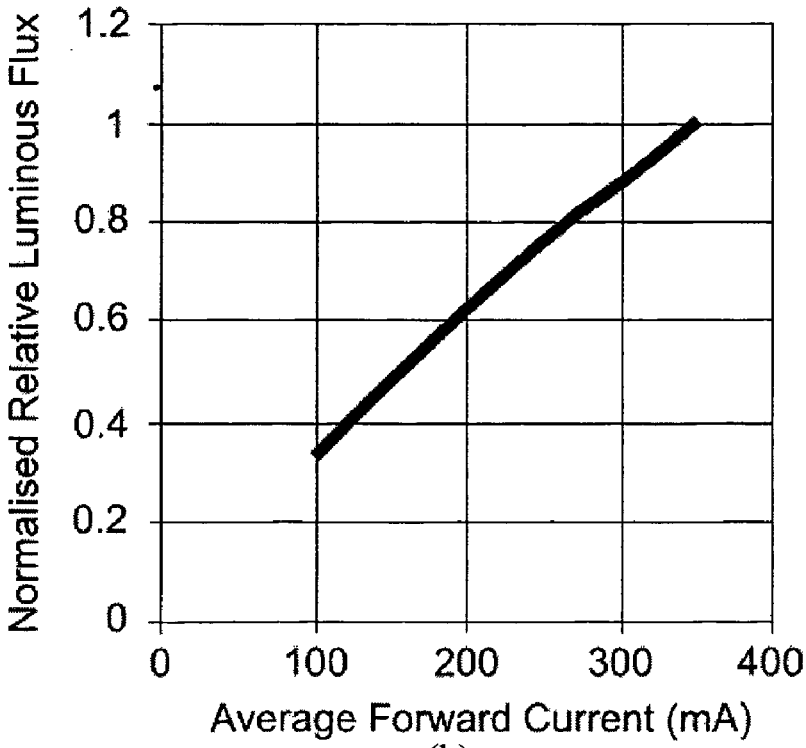
Figure 13:
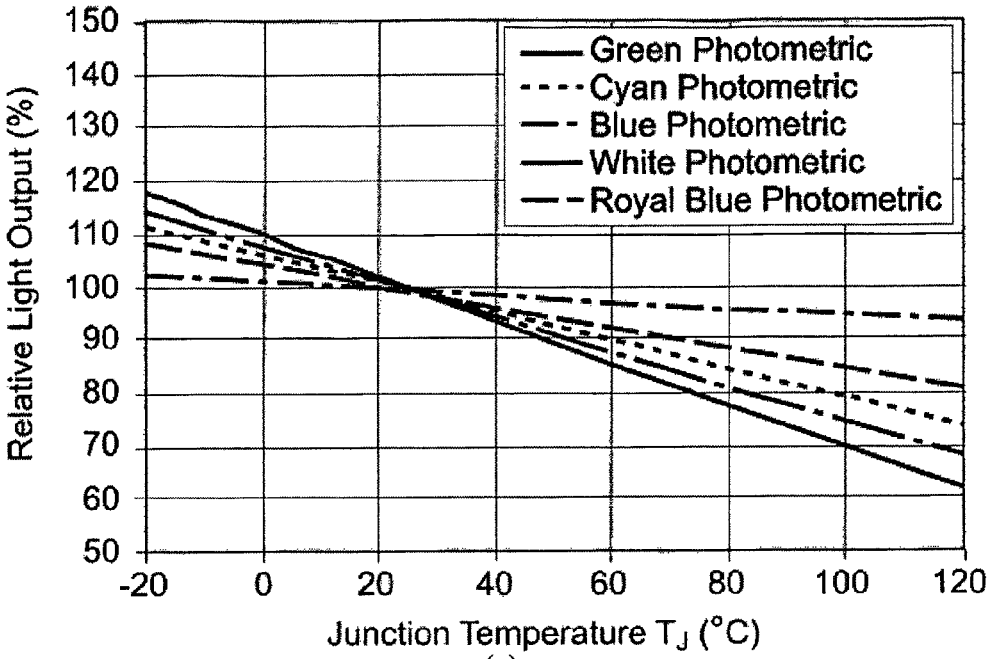
Figure 13:
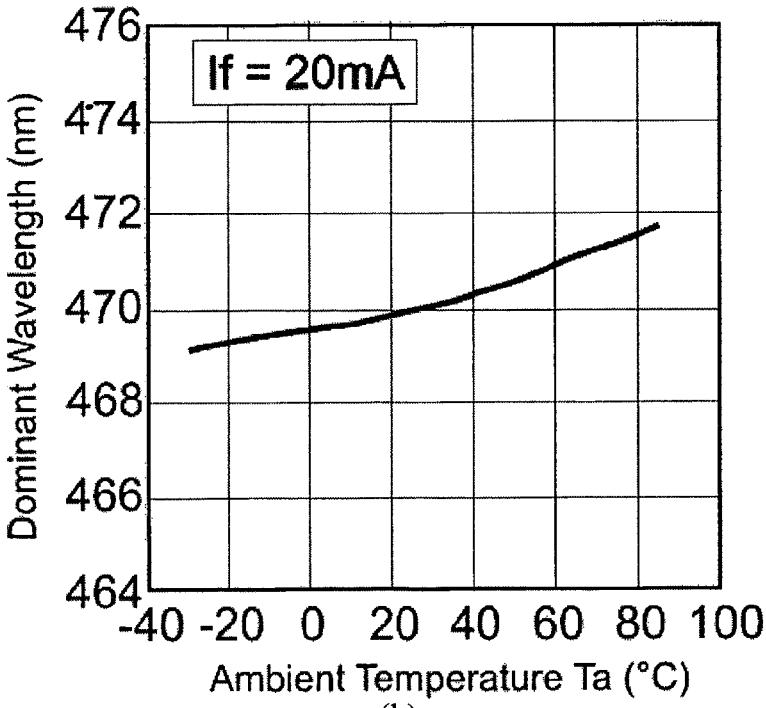
Figure 14:
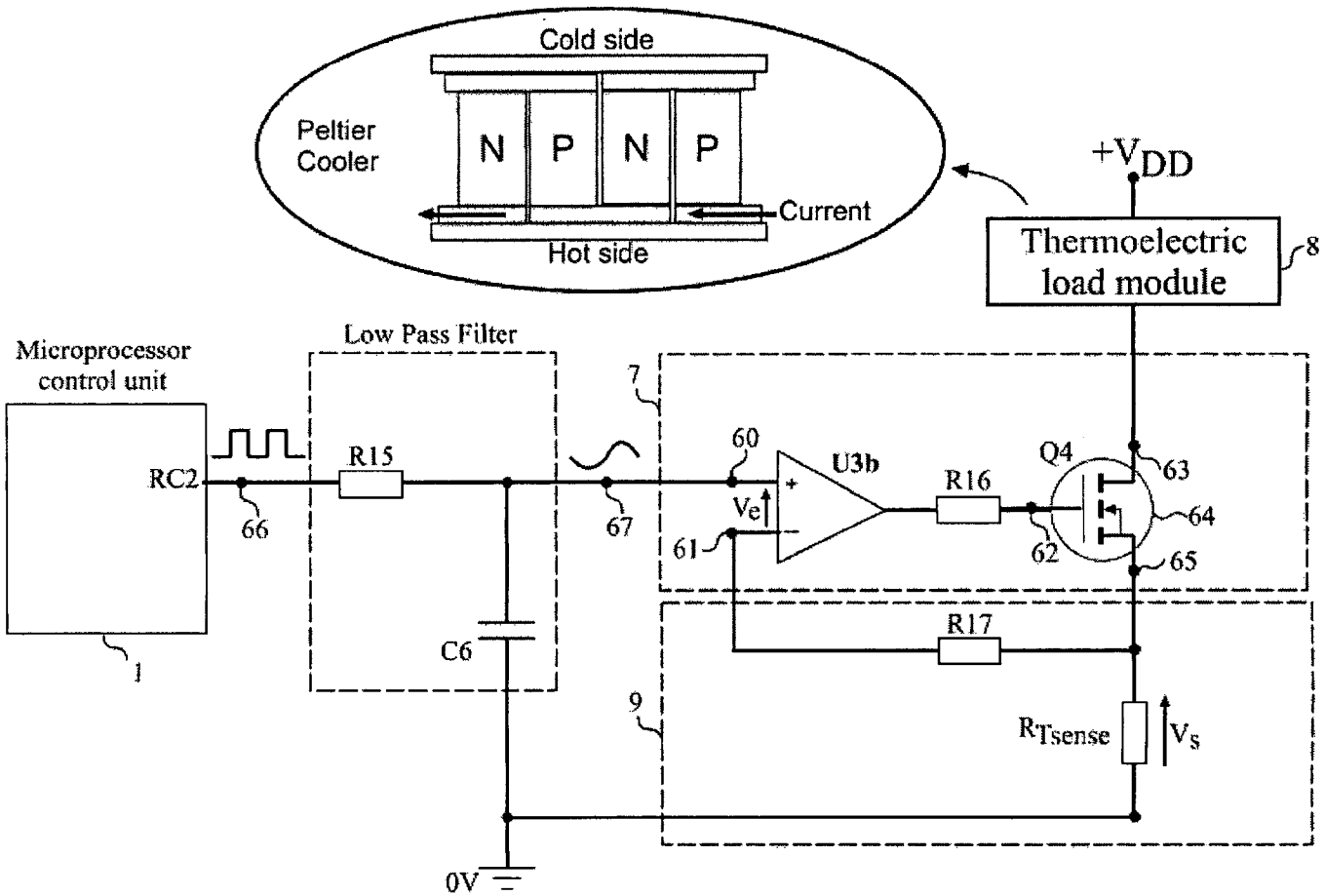
Figure 15:
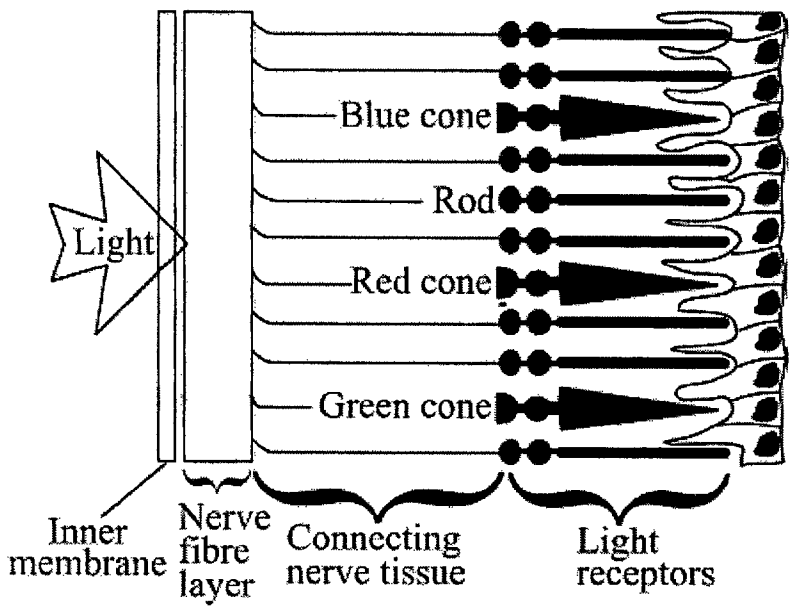
Figure 15:
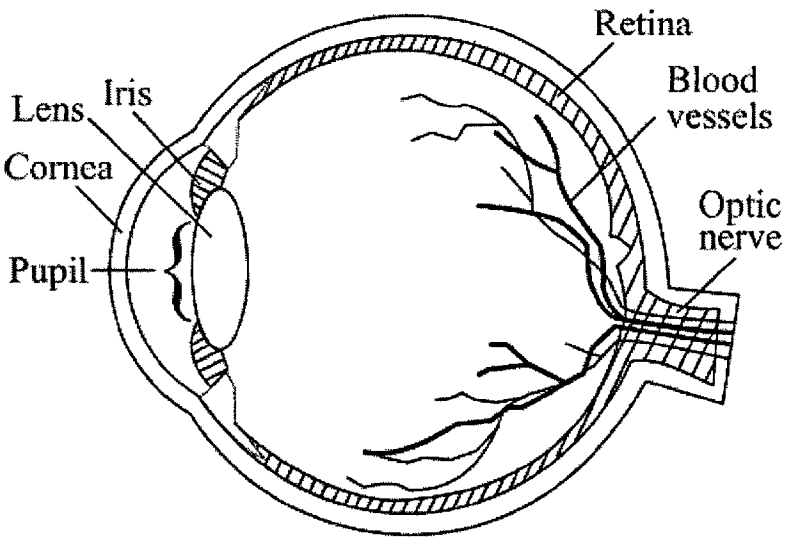
Figure 16:
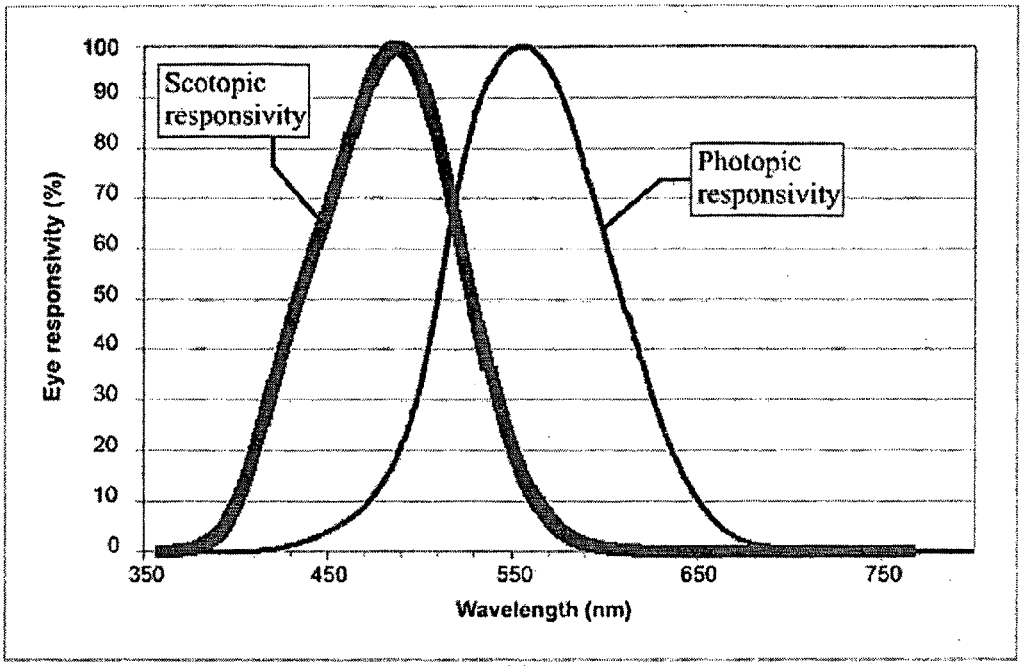
Figure 16:
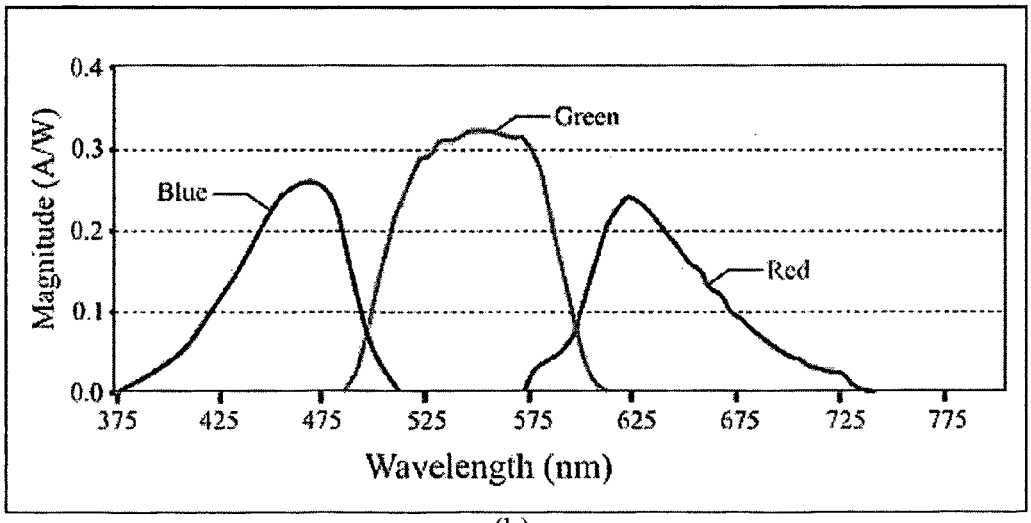
Figure 17:
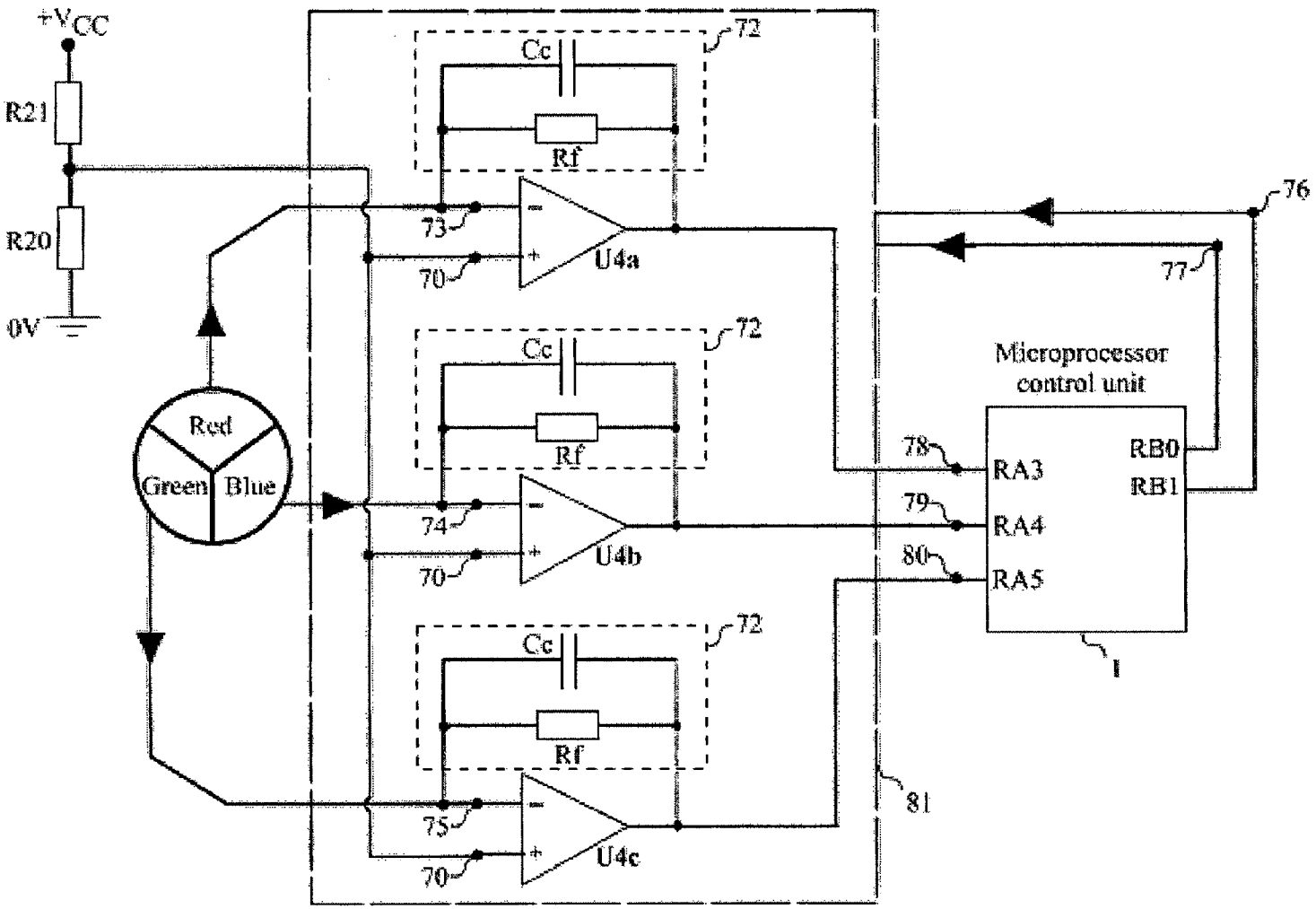
Figure 18:
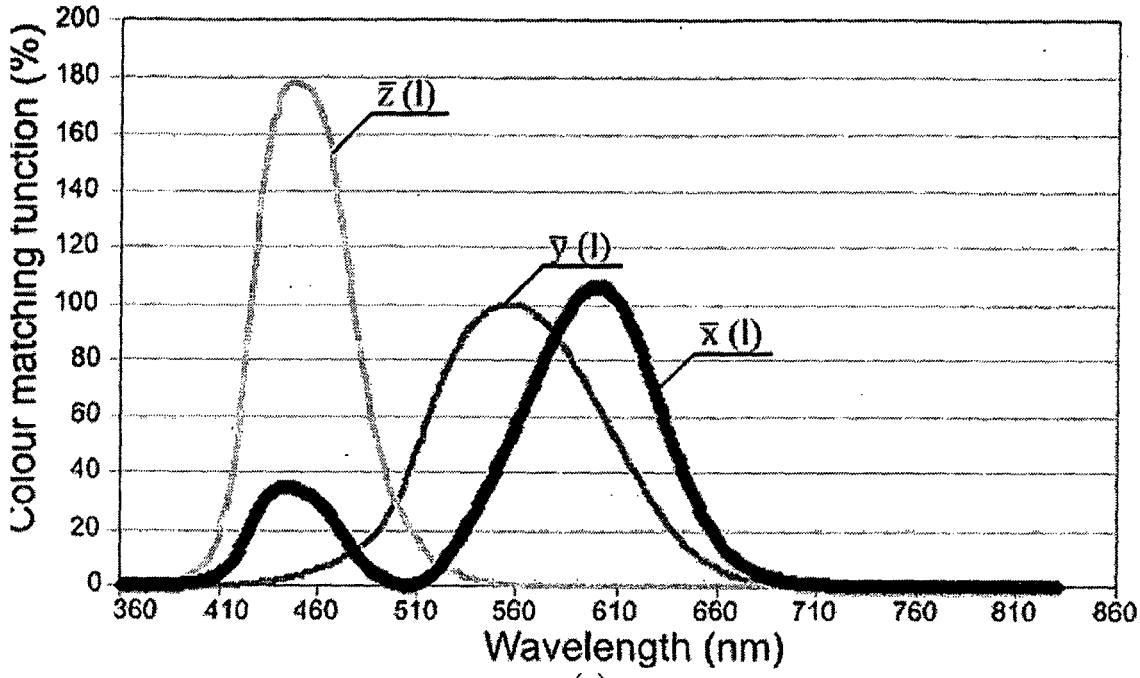
Figure 18:
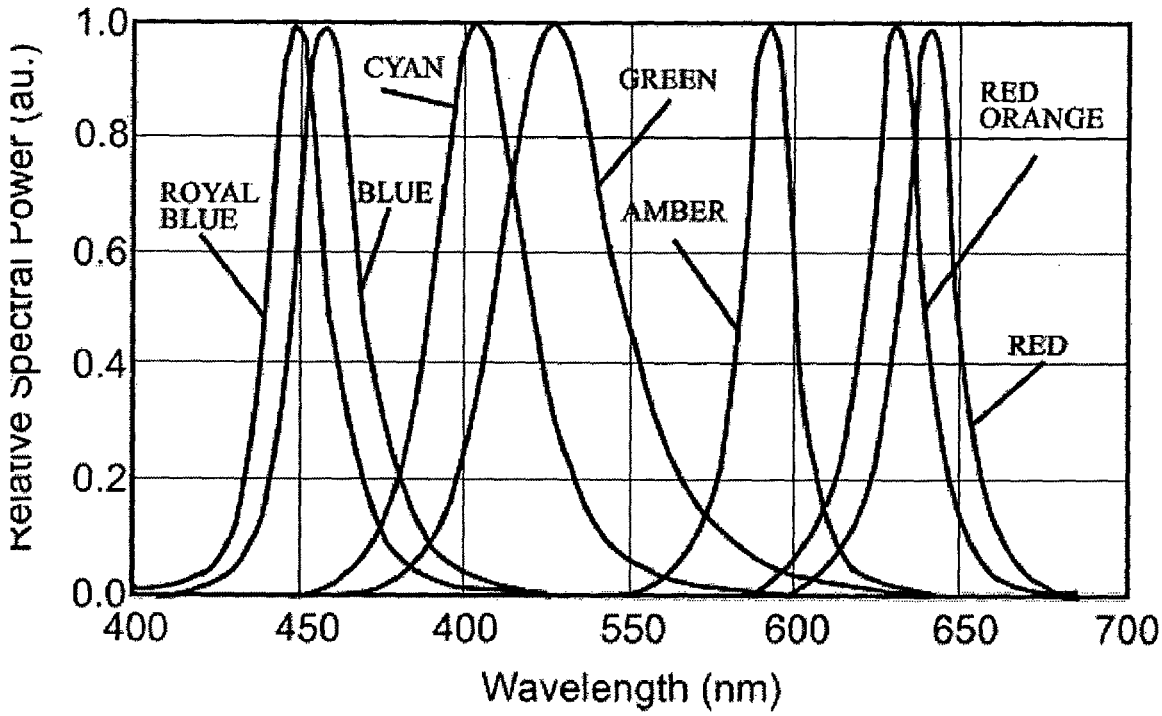
Figure 19:
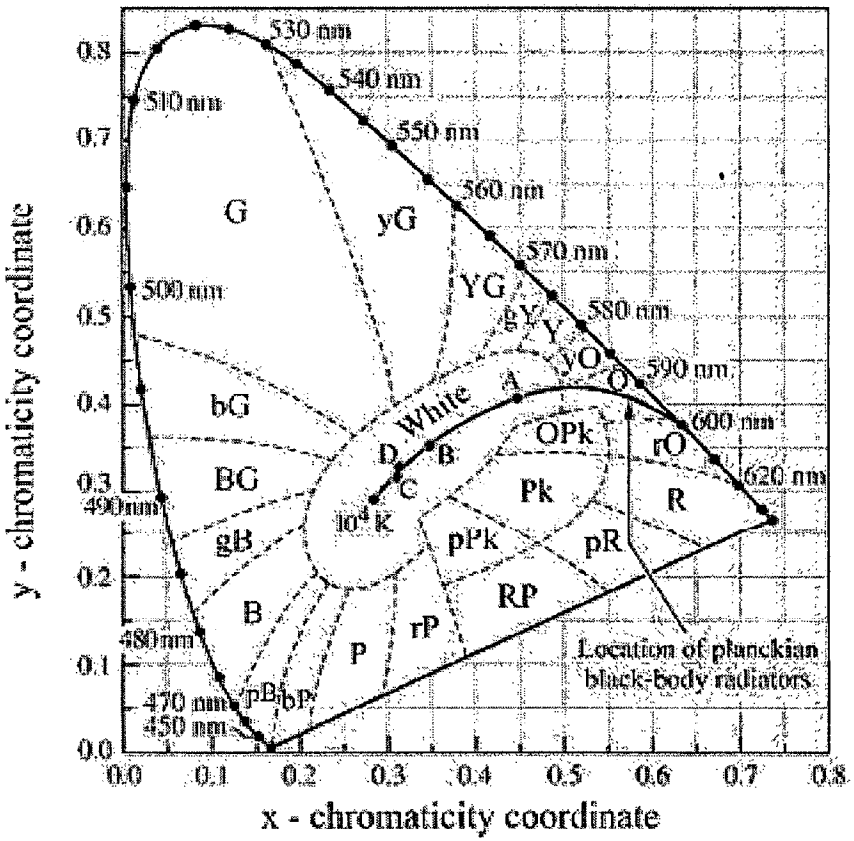
Figure 20:
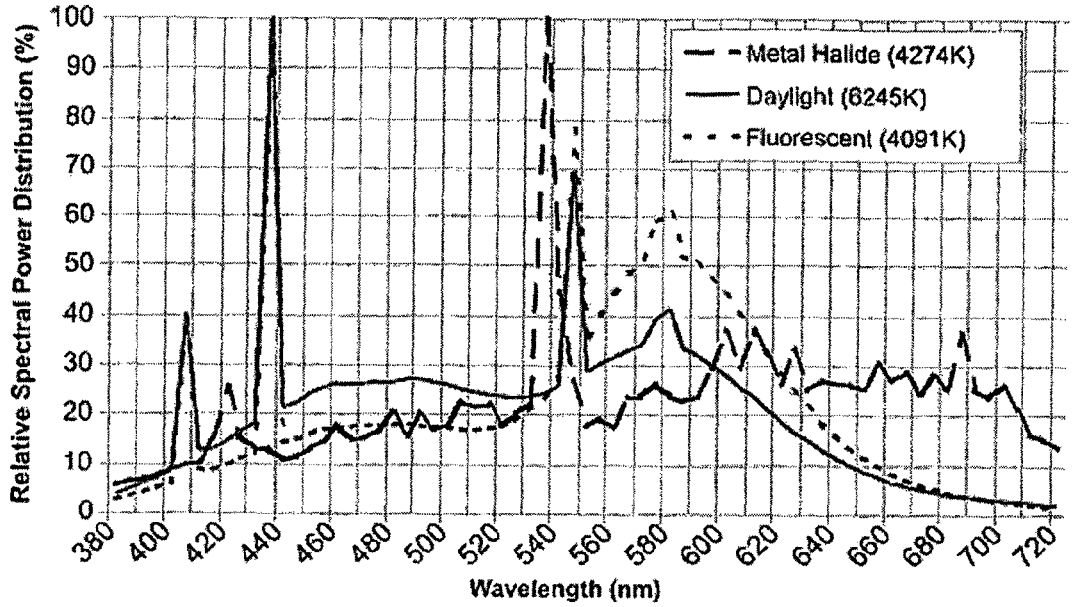
Figure 20:
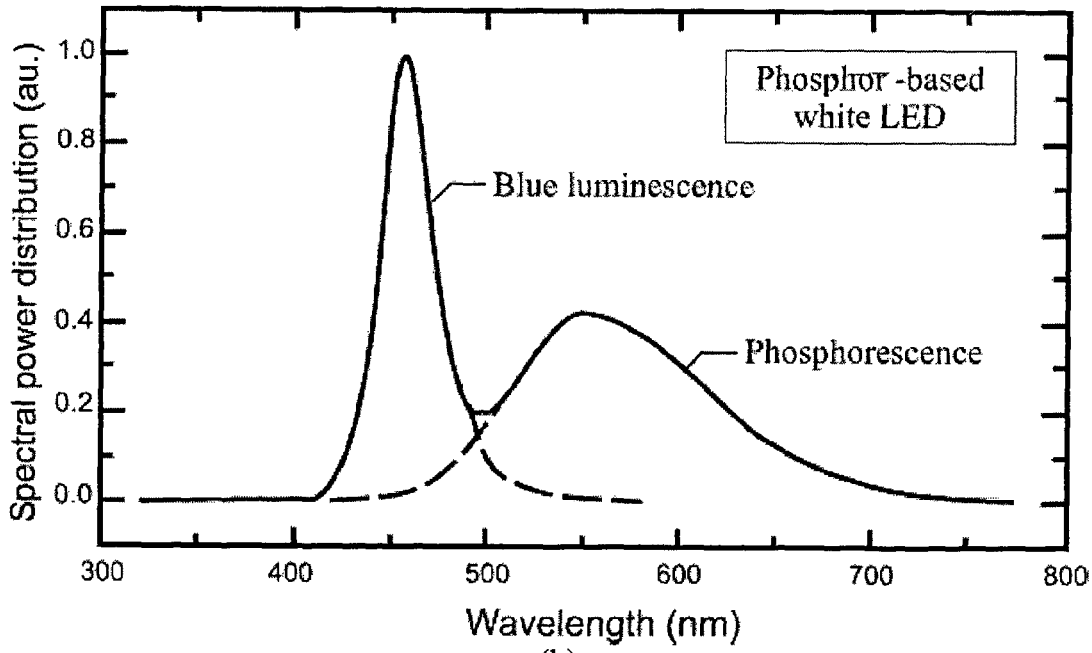
Figure 21:
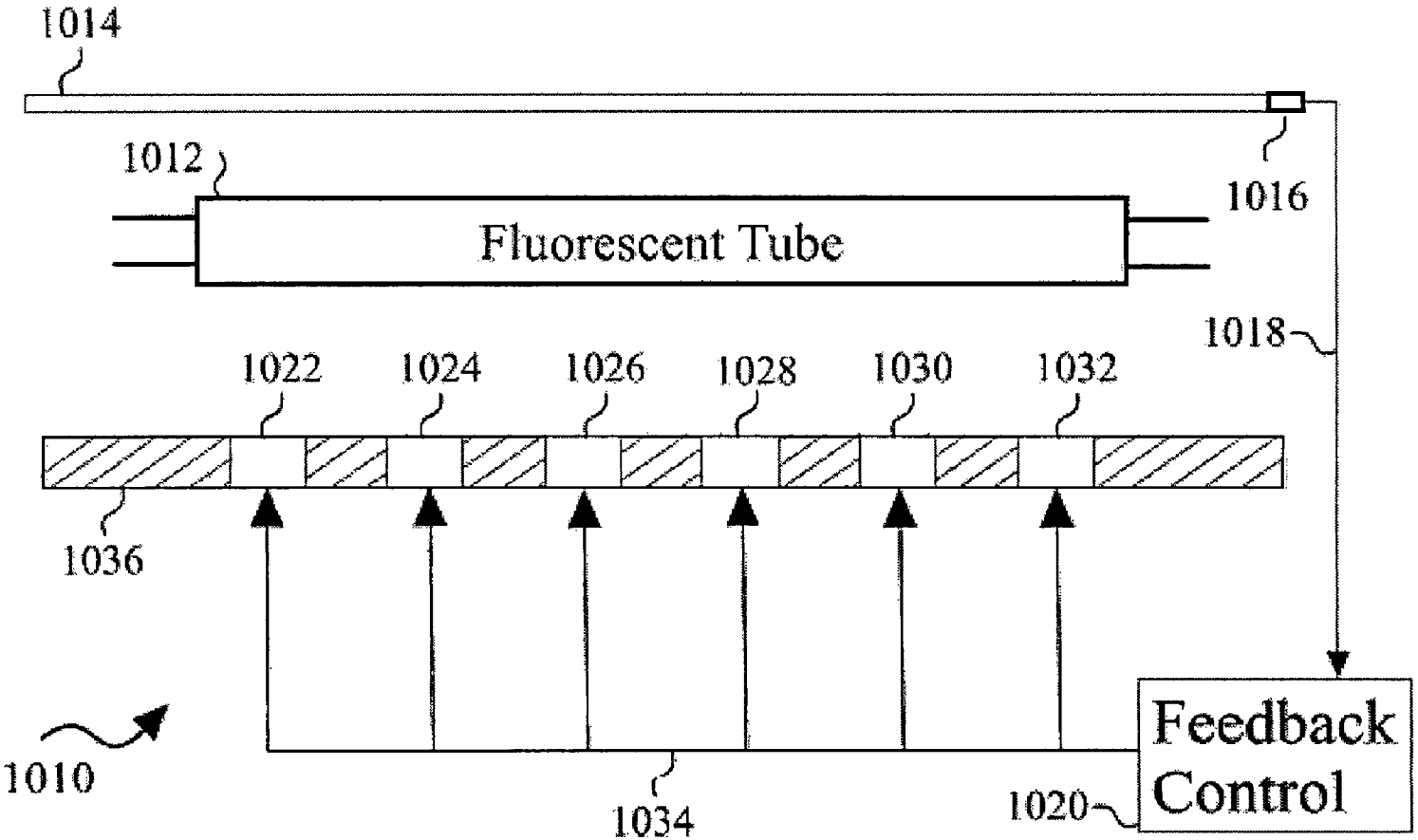
Figure 22:
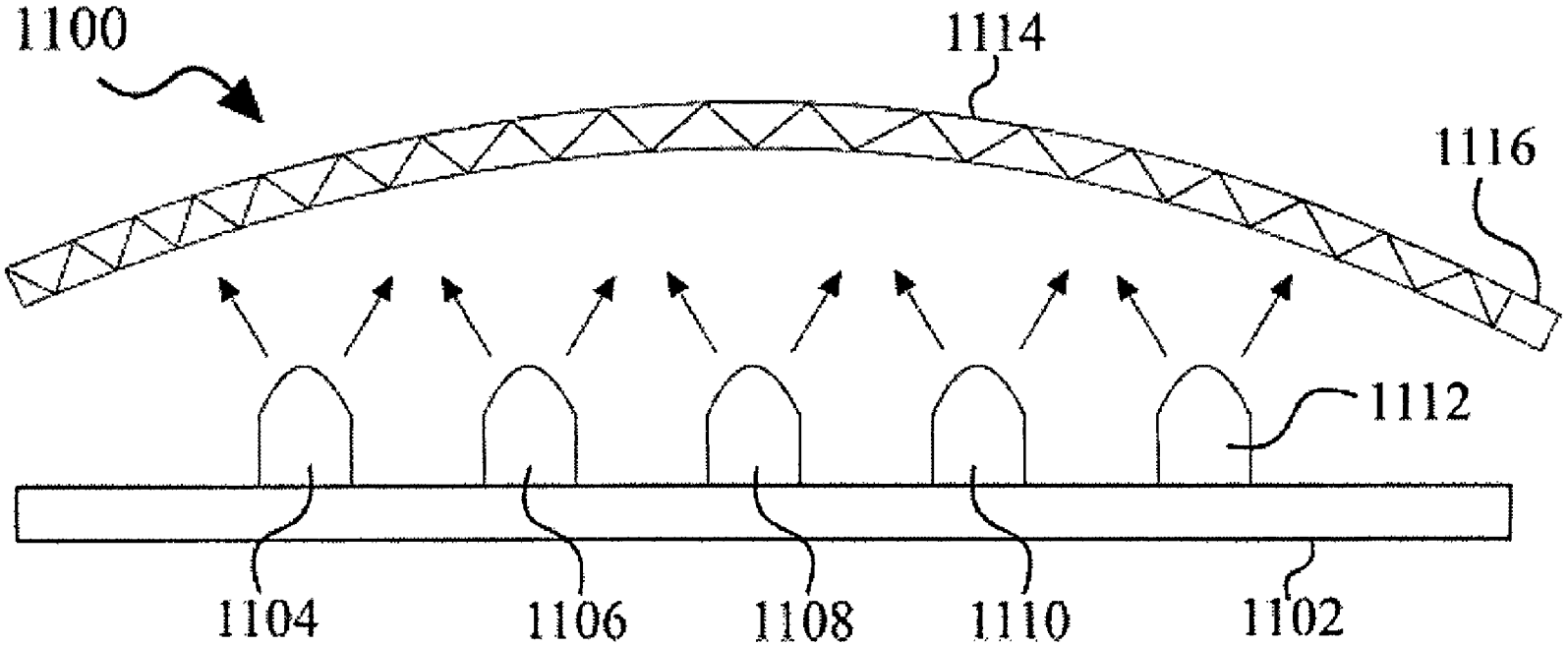
Figure 23:
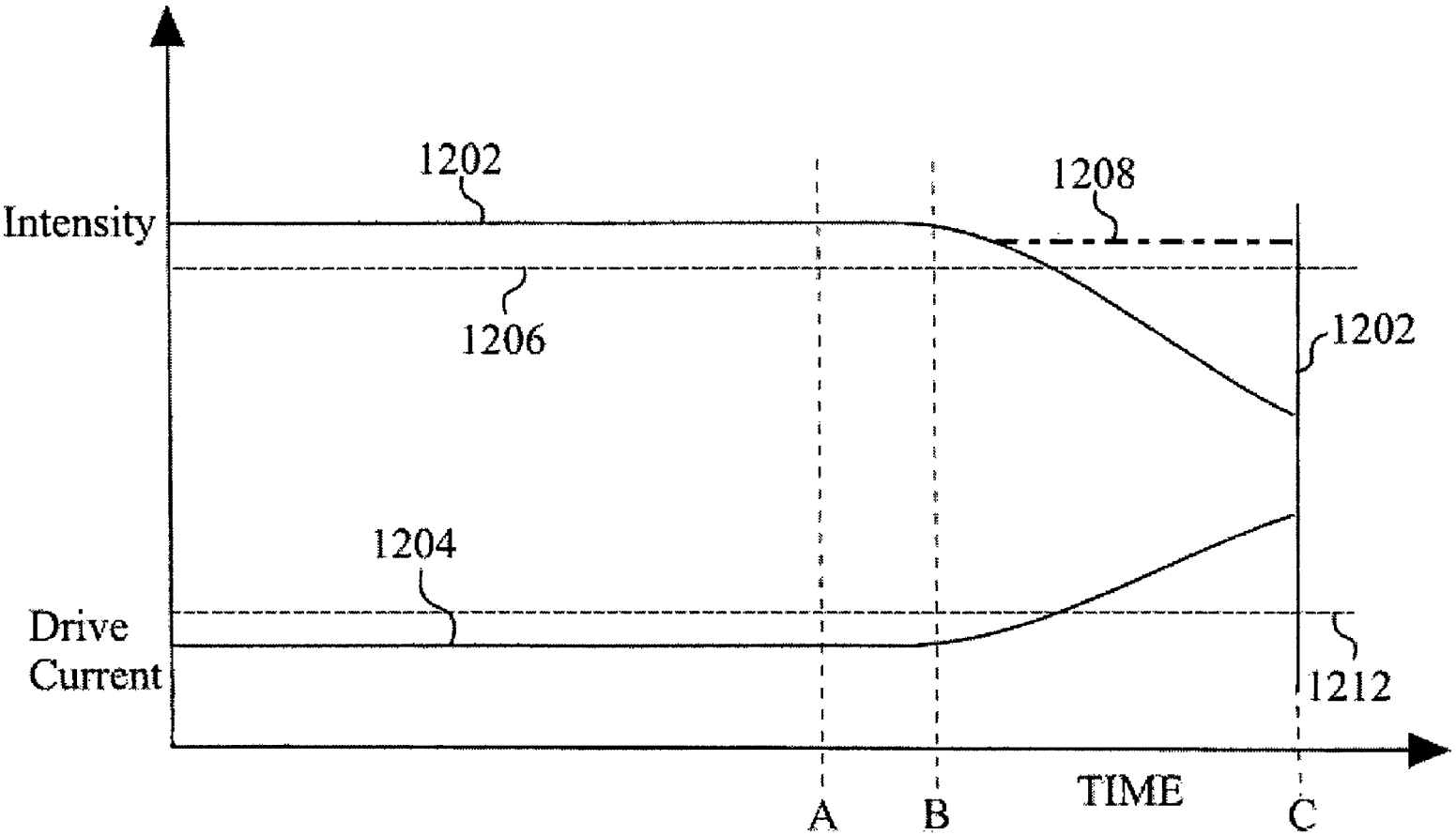
Figure 24:
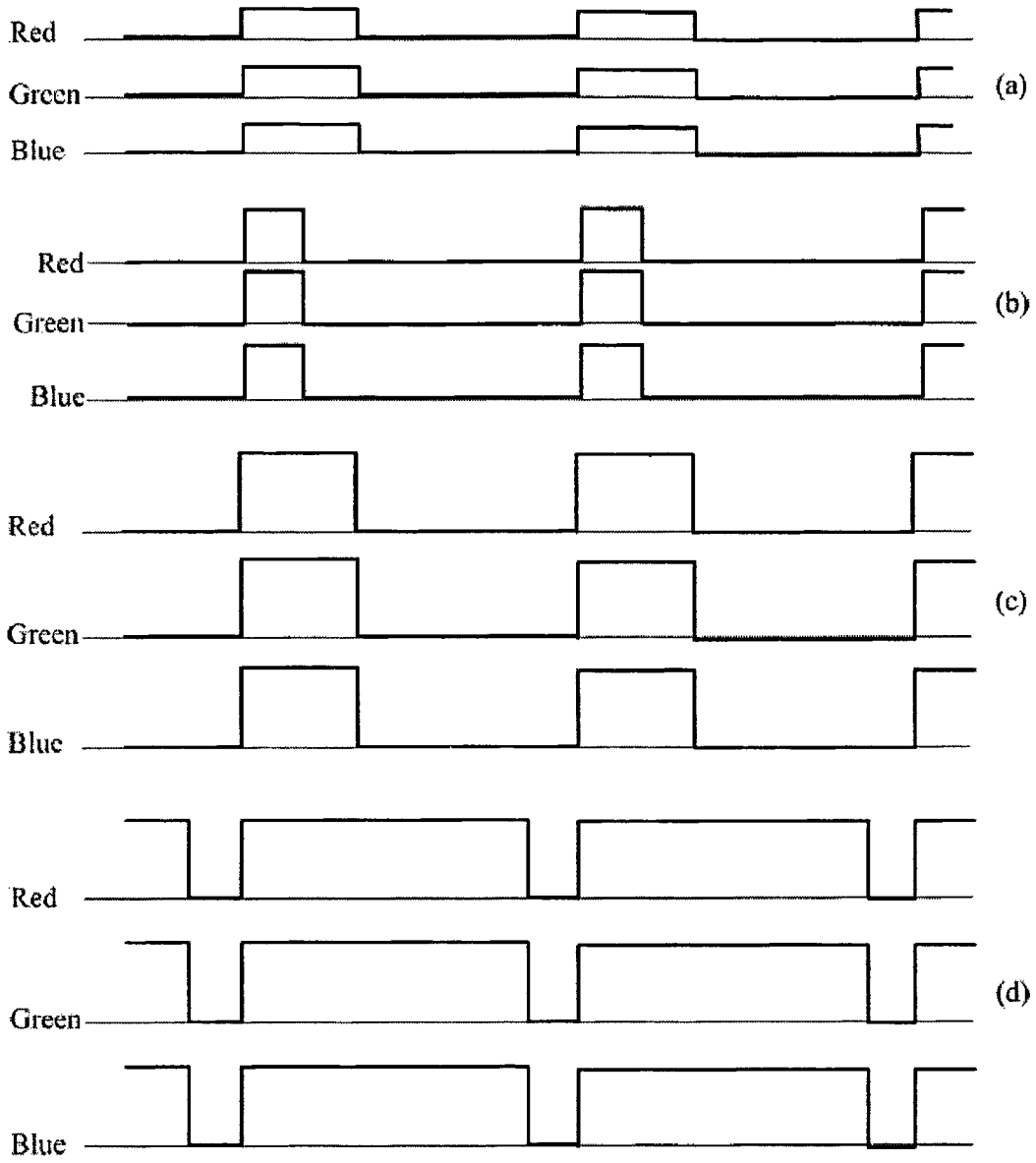
Figure 25:
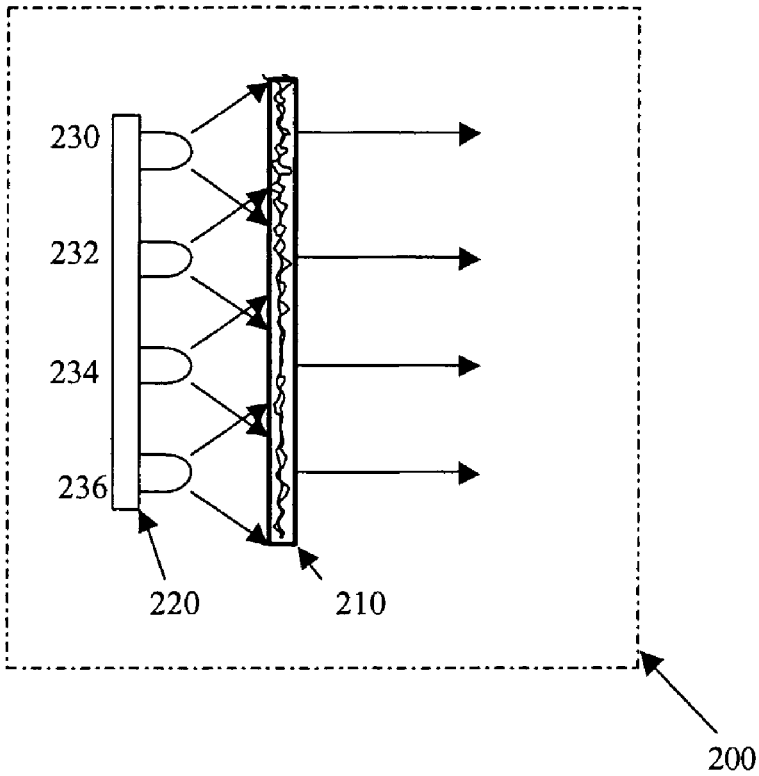
Figure 26:
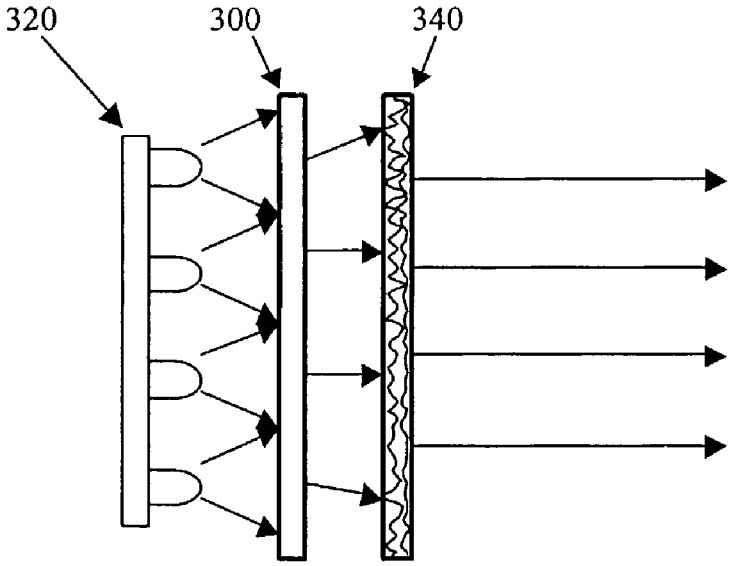
Figure 27:
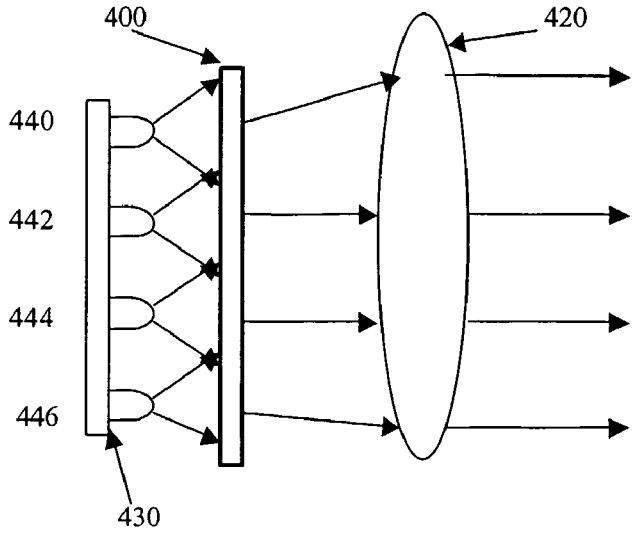
Figure 28:
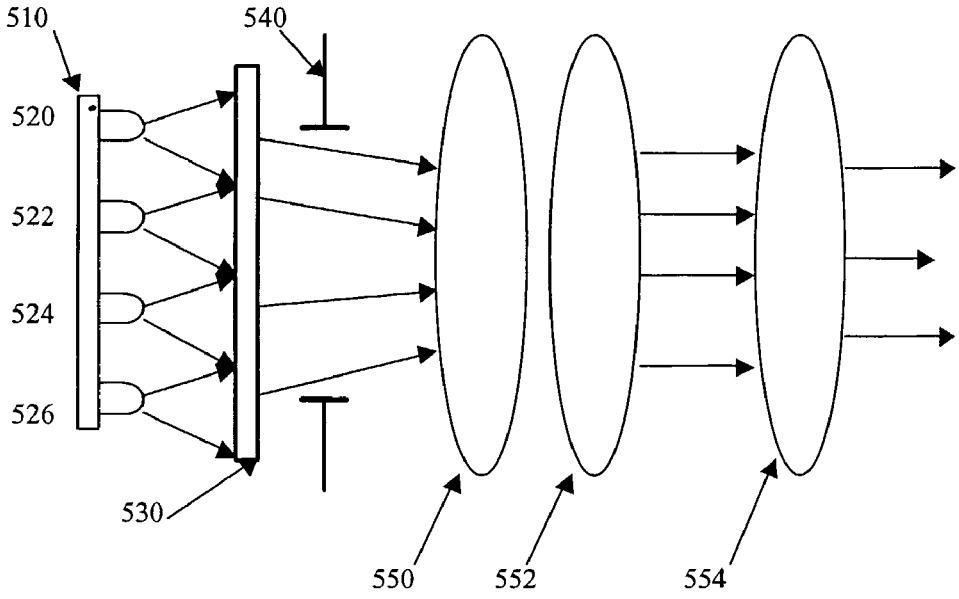
Figure 29:
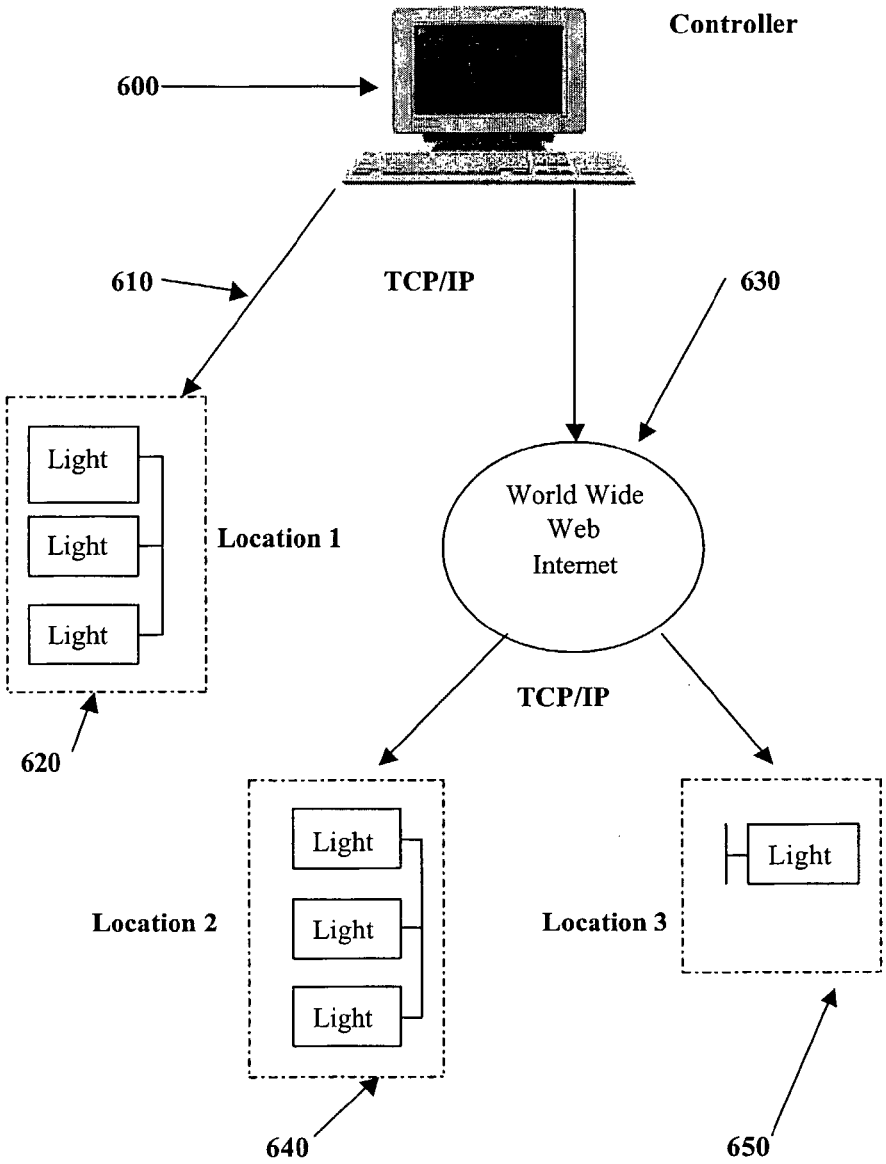

FIG. 12*a* is a graph illustrating the forward DC current versus the ambient temperature for a typical high-brightness blue or green InGan LED at various values of thermal resistance;

FIG. 12*b* is a graph illustrating the normalised relative luminous flux output versus the average forward DC current for a typical high brightness blue or green InGan LED;

FIG. 13*a* is a graph illustrating the relative light output versus the junction temperature for a typical range of high brightness LEDs FIG. 13*b* is a graph illustrating the dominant wavelength versus the temperature for a typical high brightness InGan LED;

FIG. 14 is an electrical circuit schematic of one embodiment of the thermoelectric load drive section, thermoelectric cooling load and cooling load feedback module;

FIG. 15*a* is a cross section of the human eye;

FIG. 15*b* is a block diagram of the functions of the human eye illustrating the ability of the human eye to detect colours from a range of light receptors;

FIG. 16*a* graphically represents the relative photopic and scotopic responsivity of the human eye as a function of wavelength;

FIG. 16*b* graphically represents the typical spectral sensitivity of a three-colour colour sensor;

FIG. 17 is an electrical circuit schematic of one embodiment of the colour sensor feedback module;

FIG. 18*a* is a graphical representation of the XYZ colour matching functions defined by the Commision Internationale de L'Eclairage in 1931;

FIG. 18*b* is a graphical representation of the relative spectral power distributions for a range of different high brightness LEDs;

FIG. 19 represents a typical chromaticity diagram illustrating the standardised white illuminants A, B, C, D and their respective colour temperatures;

FIG. 20*a* is a graphical representation of the relative spectral power distributions of a metal halide, fluorescent and standard daylight white light sources;

FIG. 20*b* is a graphical representation of the relative spectral power distributions of a typical phosphor-based white LED light source;

FIG. 21 shows an embodiment of the invention utilising a fluorescent light-emitting unit together with LED light emitters;

FIG. 22 shows a schematic view of an embodiment of the invention utilising optical feedback derived from total internal reflection within a cover of a light unit;

FIG. 23 is a graph showing intensity and drive current for a further embodiment of the invention;

FIG. 24 shows a number of timing diagrams that illustrate the performance of the first embodiment of the present invention;

FIG. 25 shows a schematic view of a light shaping diffuser with a LED light source arranged to provide a defined beam output;

FIG. 26 shows a multi-element light emitting diode beam collimating system;

FIG. 27 shows a multi-element beam collimating system containing at least one non-imaging micro-diffractive optic and at least one imaging optic for light beam collimation;

FIG. 28 shows an embodiment of the invention utilizing a light beam collimator, aperture and projection lens for variable beam output; and FIG. 29 shows a schematic view of an embodiment of the invention, enabling the light fixture to be controlled through a standard computer network and the internet.

Figure 1:
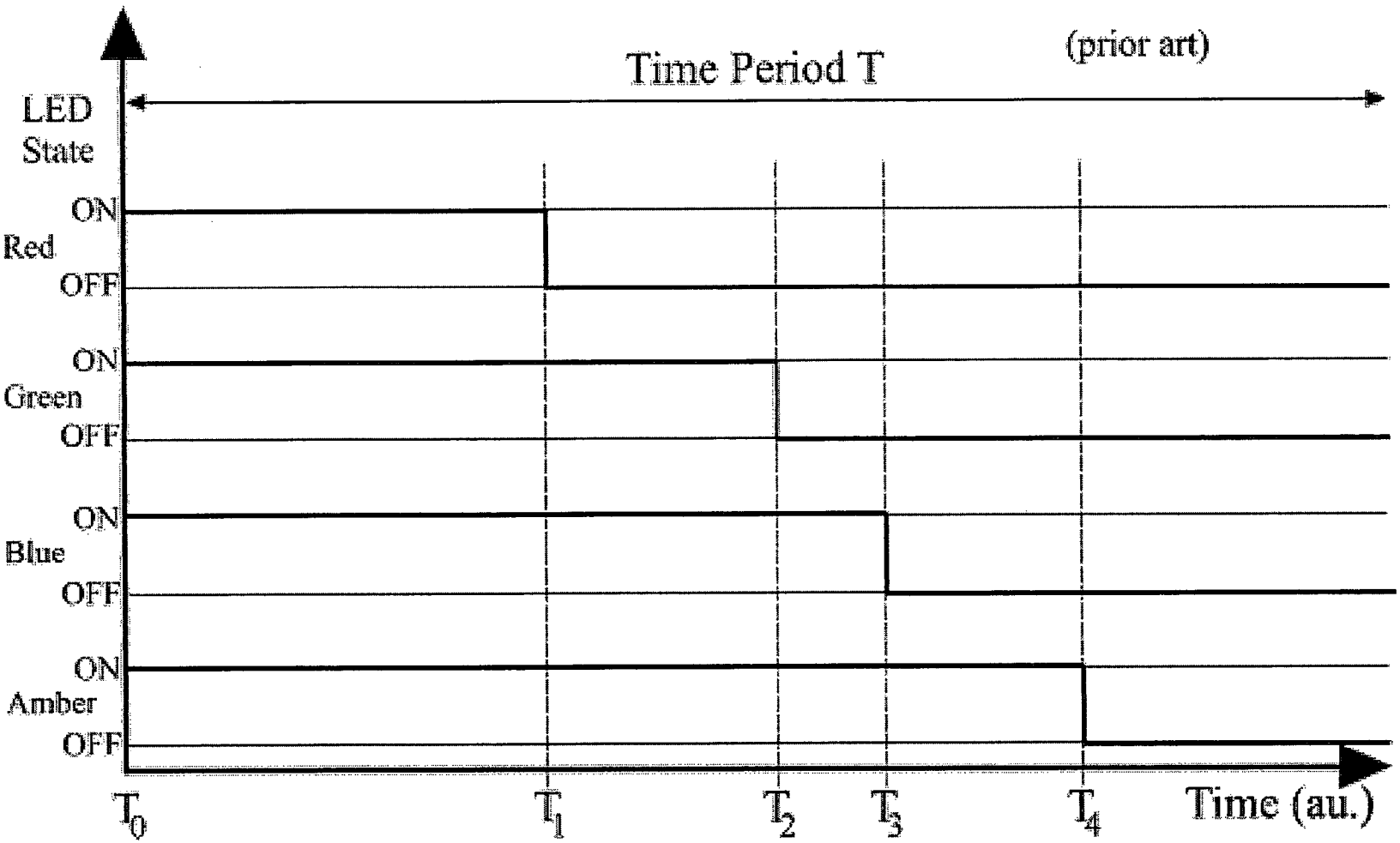
FIG. 1 illustrates by way of a timing diagram the colour imbalance that can result from (prior art) PWM drive techniques.

FIG. 1 shows driving waveforms of four colour channels covering red, green, blue and amber parts of the visible spectrum that are driven by a PWM technique. It is clear that for particular colour settings, the LED cluster will exhibit several different colours and intensities that makes it impossible, especially for use with solid state TV cameras, to adequately control colour, intensity, correlated colour temperature (CCT) and colour rendering index (CRI). FIG. 1 assumes that all colour channels are synchronised at TO but in practice this may not occur and further colour and intensity discrepancies would result.

Figure 2:
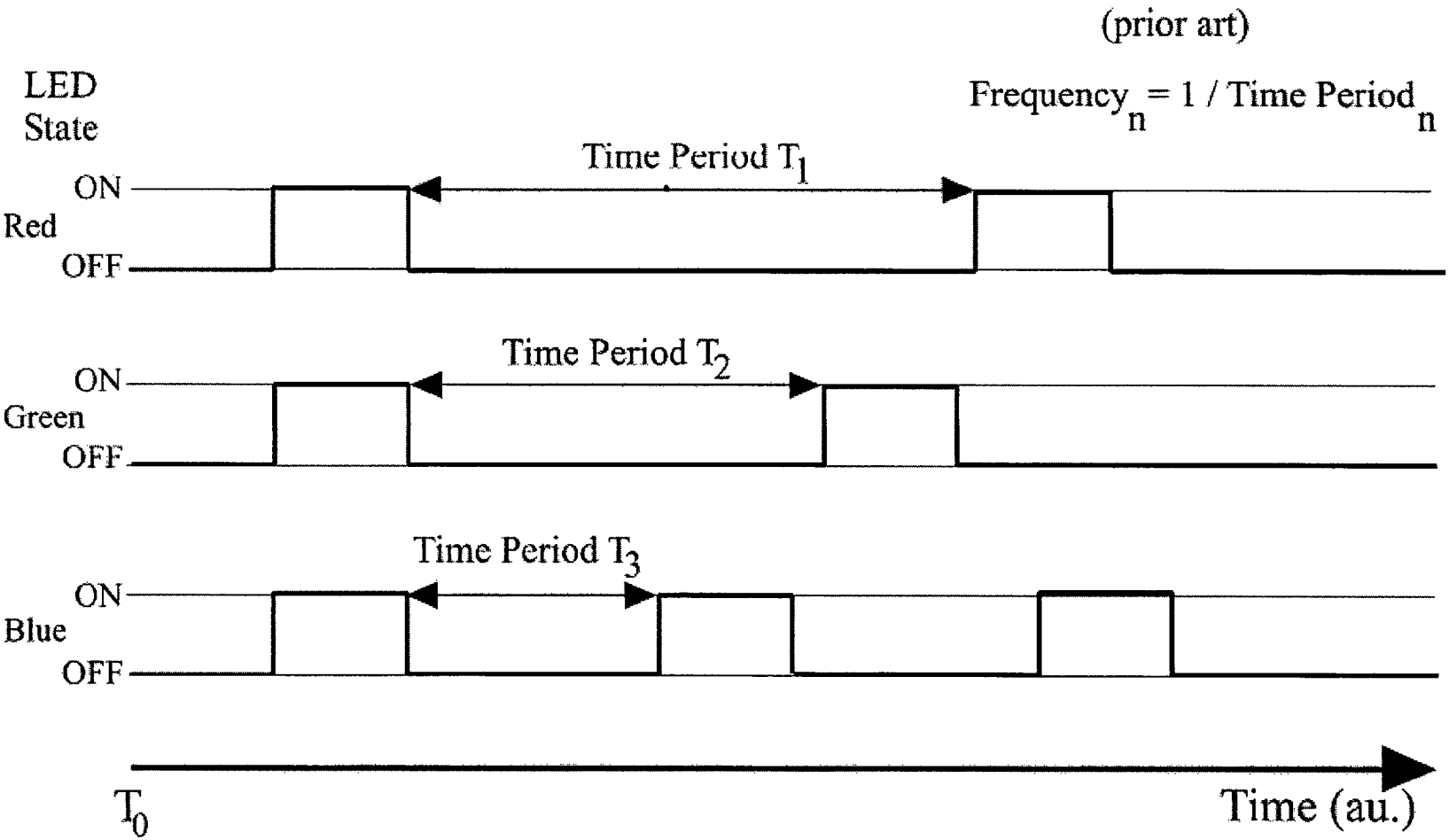
FIG. 2 illustrates by way of a timing diagram the colour imbalance that can result from (prior art) PFM drive technology.

FIG. 2 shows an alternative method for driving LEDs, that of Pulse Frequency Modulation (PFM). PFM utilises pulses of equal amplitude and duration that are generated at a rate determined by the signals' frequency but again this technique does not enable true colour mixing or precise CCT control when two or more wavelengths or colours are used within an LED cluster. The figure illustrates how using PFM leads to very poor colour mixing, CCT and CRI properties as well as different signal frequencies for each colour channel.

Figure 3:
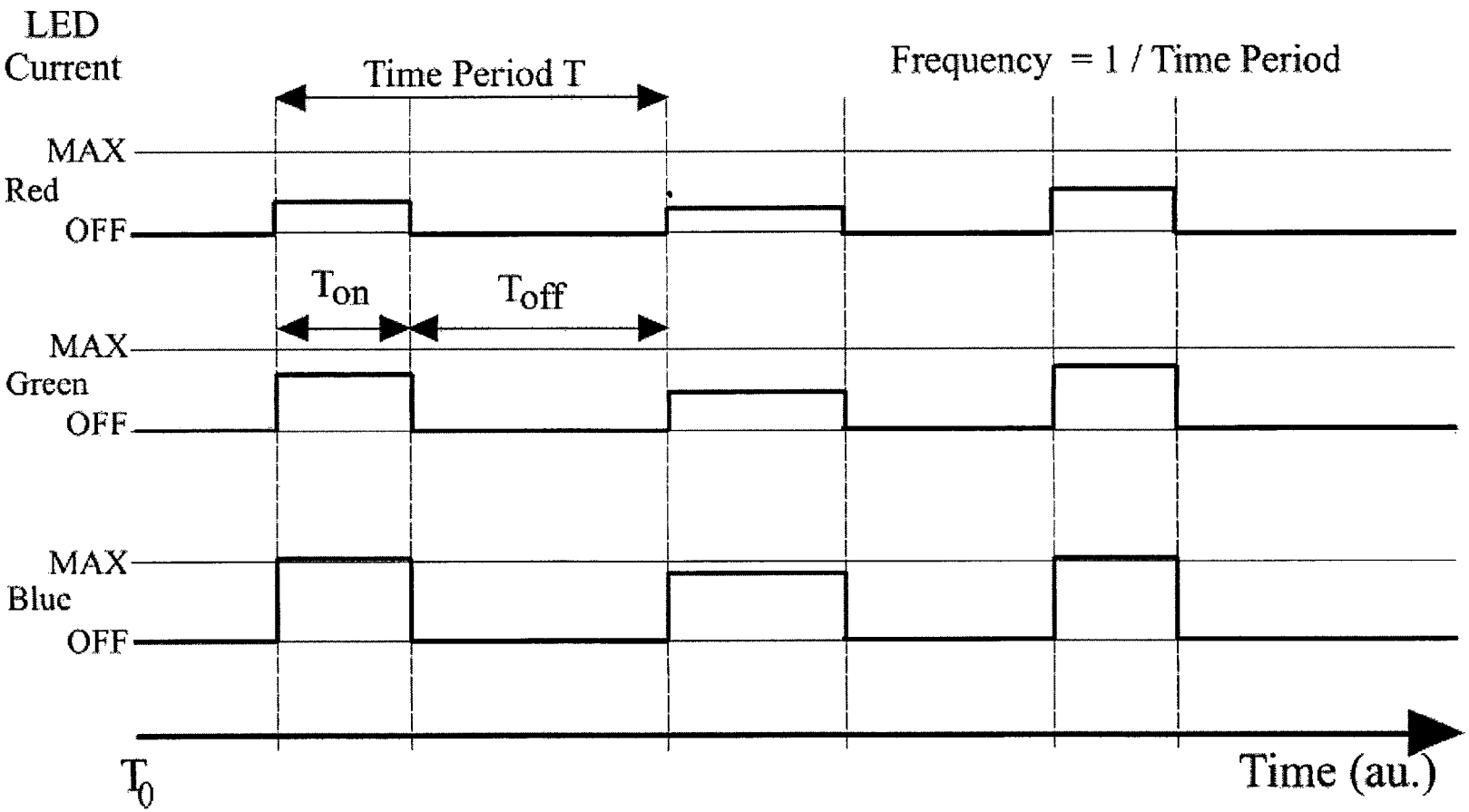
FIG. 3 illustrates by way of a timing diagram, the colour balance that results from PAM driving technology.

An additional method of driving LEDs is that of Pulse Amplitude Modulation (PAM) which controls the current through each LED colour channel by varying the amplitude of the current. This method has many advantages for driving LEDs such that all of the colour channels can be pulsed at exactly the same time enabling true control of colour mixing, CCT and CRI. FIG. 3 illustrates such PAM driving waveforms. While square waves are shown it should be noted that other waveforms such as trapezoidal or even analogue waveforms such as sinusoidal may be used.

FIG. 24 illustrates the principles underlying the first embodiment of the invention by way of a timing diagram. FIG. 24(*a*) shows the PAM driving waveforms for red (R), green (G) and blue (B) emitters at a low intensity. Unfortunately, since LEDs are non-linear devices, driving them at very low current levels results in inefficient driving or in extreme cases, no driving at all.

To address this, the present embodiment may vary the pulse width of the driving waveforms. FIG. 24(*b*) illustrates the same amount of power being applied to each of the three colour channels but the power is located in pulses of around half the previous duration. The intensity of the drive can thus be increased to a level at which each LED or LEDs are driven in a more efficient, or in a preferred arrangement linear, operating region. Because the duration of the pulses has been reduced, the overall light output is still at the (low) desired level.

FIGS. 24(*c*) and 24(*d*) illustrate the opposite scenario in which a very high intensity is required and this may even be sufficiently high to place the LEDs themselves at risk. Instead of using the 50% mark-space ratio shown in FIG. 24(*c*), the pulse ON time is lengthened within a cycle to permit a lower absolute drive amplitude to be applied to the LEDs. This is shown in FIG. 24(*d*).

Alternatively, the width of the individual pulse may be maintained while altering the pulse repetition period (lengthening for low light values and shortening for high light values). As in the first alternative, this permits an appropriate level of drive to be applied to LED or LEDs for a given power output. Note that this differs from PFM in that the colour outputs remain synchronised.

Both the PWM and PFM techniques are widely utilised within LED based lighting and display applications as they often assume that the light will be received by the human eye. As the human eye (FIG. 15a) has an integrating function, it is assumed that colour discrepancies will not be noticed provided the pulse repetition frequency is above a few hundred Hertz. However, this is not applicable to solid state camera systems in which illumination of the subject using PWM will result in flicker and poor colour balance. It should also be noted that the current generation of high brightness inorganic semiconductor LEDs available from LumiLEDs Lighting of San Jose, Calif., USA advise using somewhat lower modulation frequencies than this.

Figure 4:
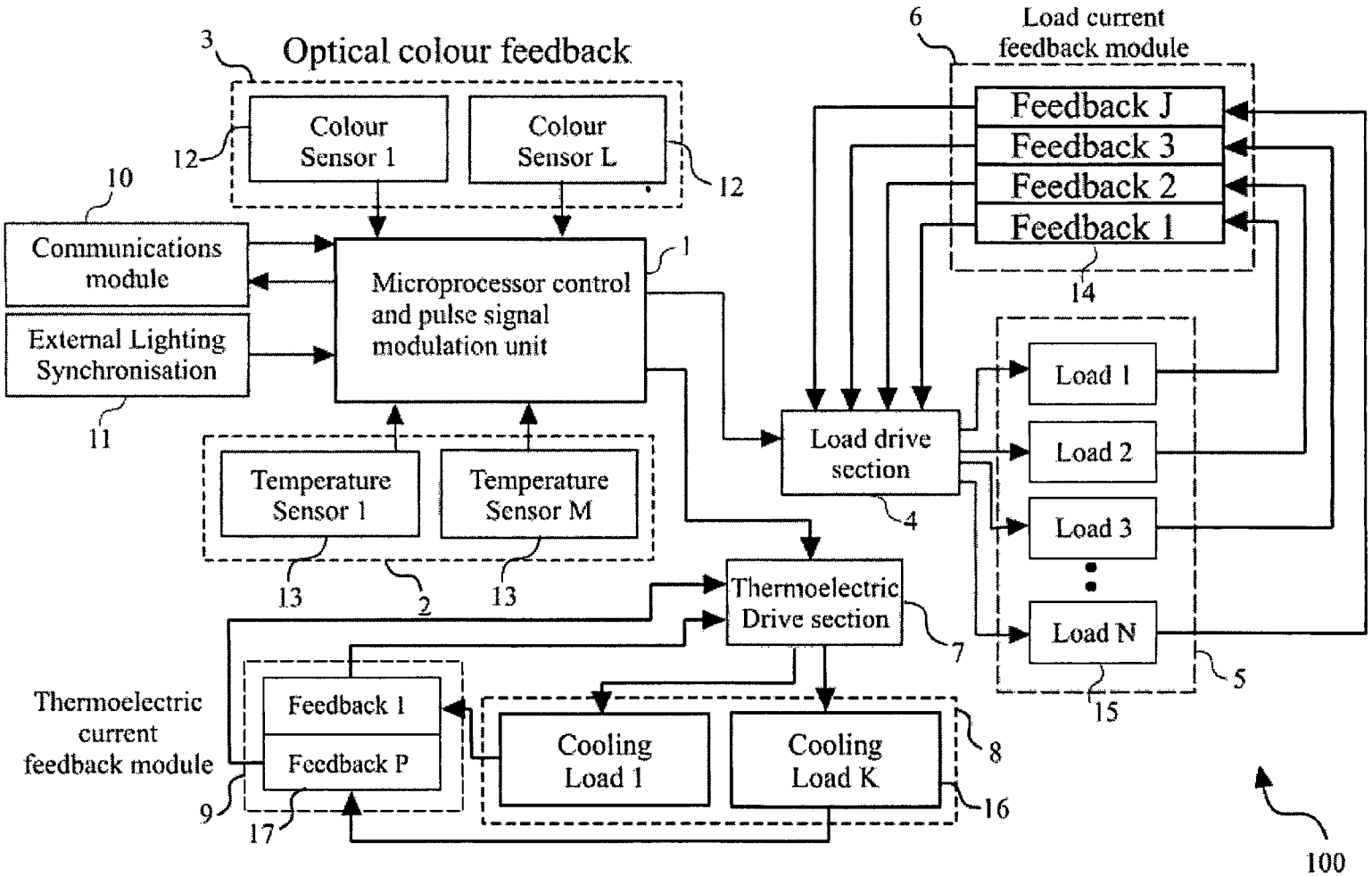
FIG. 4 shows a block schematic diagram of a first embodiment of the present invention comprising microprocessor control to effect synchronised LED drive signals and including an optional thermoelectric feedback circuit.

FIG. 4 shows a block diagram of an illumination control system 100 according to the first embodiment. The system comprises a microprocessor 1 used to control the system and to generate amplitude modulation signals in response to inputs from a temperature sensor module 2 and a colour sensor module 3. A load drive section 4 receives inputs from both the microprocessor 1 and the load current feedback module 6. It also has an output connected to the load 5 which in turn provides an output to the load current feedback module. An optional thermoelectric drive section 7 has inputs from the microprocessor and a cooling load feedback module 9. The section 7 has an output connected to a thermoelectric load module 8 which in turn provides an output to the cooling load feedback module 9. An optional communications module 10 provides bi-directional data communication between the microprocessor and one or more external devices or controllers. An external lighting synchronisation module 11 is provided to form an interface to an external synchronisation signal such as from a solid state camera when such synchronisation is required.

A temperature sensor module 2 includes a plurality of temperature sensors (13), the colour sensor feedback module 3 includes at least one and preferably a plurality of colour sensors 12 and the load drive section includes at least one and preferably a plurality of load drivers (not shown) for driving a plurality of loads. The load current feedback module comprises a plurality of load current feedback sensors while the thermoelectric drive section 7 includes a plurality of thermoelectric drivers (not shown) used to drive a plurality of cooling loads 16 and the thermoelectric current feedback module contains a plurality of cooling load current feedback sensors.

The embodiment operates as follows. A required light intensity and colour are received from an external controller via communications module 10. The microprocessor then calculates the appropriate drive intensities for each of the different colour channels within the system. In doing so, any feedback from the optical colour feedback module 3 will be taken into account. The microprocessor will then determine the drive current, pulse width and pulse repetition frequency that best matches the required intensities in each channel. For instance, that channel with the lowest required intensity must be driven at a sufficiently high drive level to ensure illumination, while that channel at the highest required intensity must not be driven to such a level (considering the thermal feedback from the temperature sensing module 2) that the Load LEDs are jeopardised. Once appropriate pulse widths and intensities have been calculated, the load drive section 4 is instructed to apply the appropriate pulses to the loads—always within the requirement that the duration and timing of the pulses on each channel are the same. This results in synchronised control.

Where one or more colour channels require a much lower drive intensity than other channels is may be appropriate not to drive some of the LEDs in that or those colour channels.

The Load Drive Section 4 and the load current feedback module 6 cooperate to control the current through the load LEDs to ensure both adequate drive and overload protection.

Figure 5:
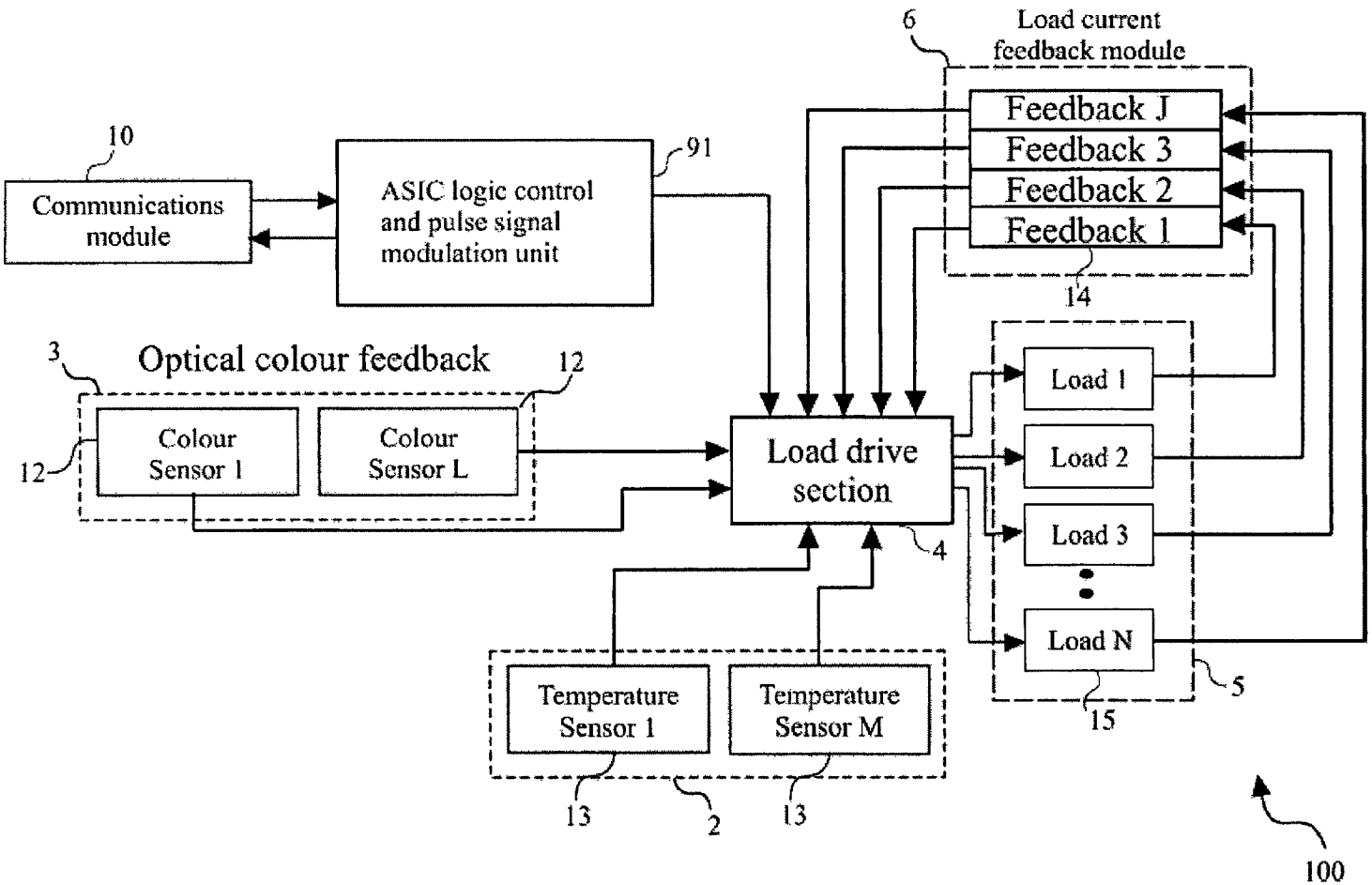
FIG. 5 shows a block schematic diagram of a second embodiment of the present invention utilising a control module embodied in an Application Specific Integrated Circuit (ASIC) to generate synchronised LED drive signals.

Referring to the block diagram of FIG. 5 a second embodiment of the illumination control system 100 is shown. In this embodiment the communications module 10 communicates not with a microprocessor but with a logic control circuit embodied in an ASIC 91. In this embodiment the temperature feedback is applied to the load drive section 4, as is the optical colour feedback from module 3. The optional thermoelectric drive section has been omitted.

The ASIC 91 is designed to perform the functions (with the exception of the temperature and colour feedback) previously performed by the microprocessor in the first embodiment. The ASIC may comprise a small, cheap Field Programmable Gate Array (FPGA) such as the Xilinx XC9572XL from Xilinx Inc. San Jose Calif., USA to a mixed signal ASIC carrying additional circuitry for the illumination control system and even further circuitry for any system integrated therewith.

Figure 6:
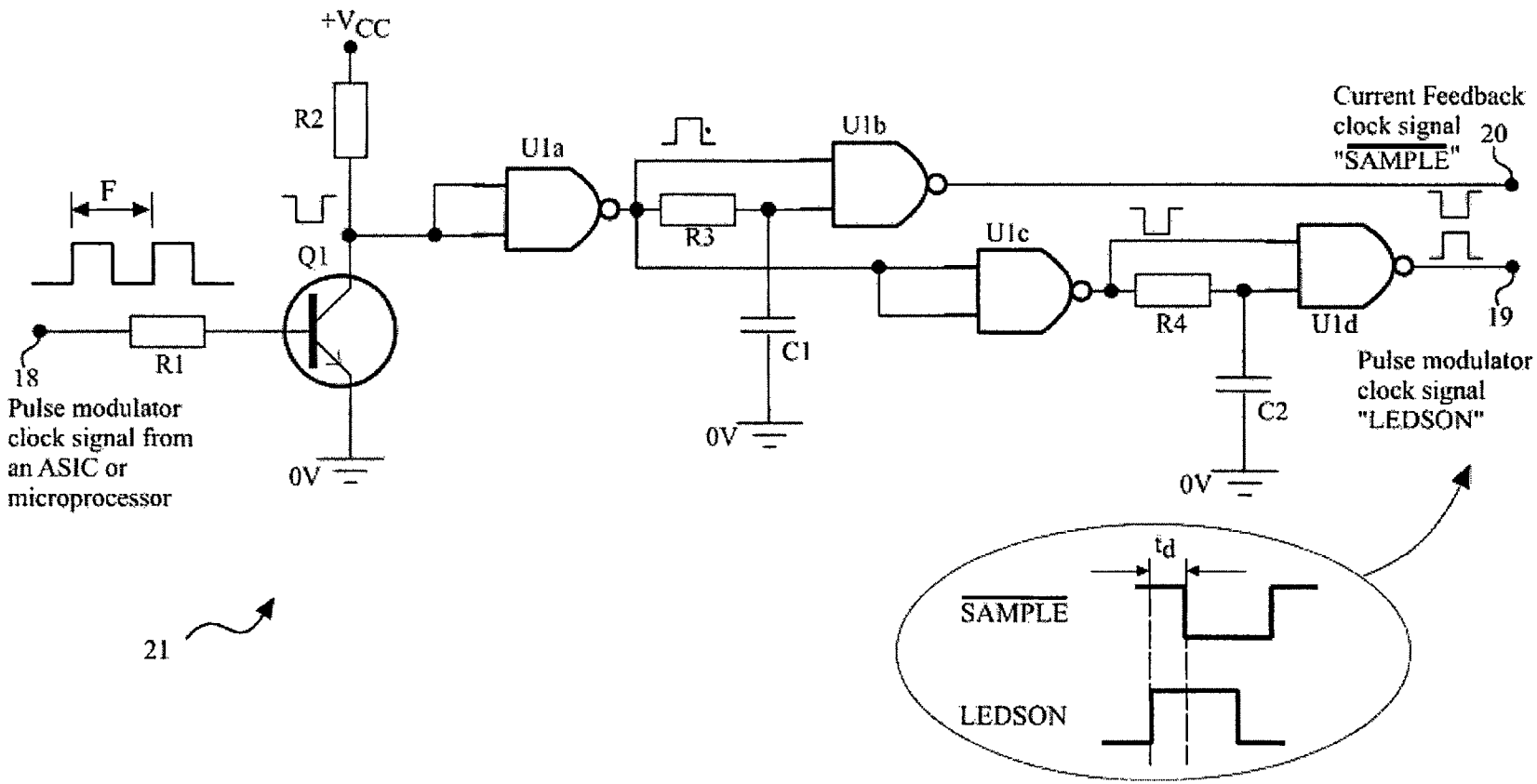
FIG. 6 is a circuit schematic of an embodiment of a pulse signal generator to generate a pulse modulator clock signal with a defined frequency and duty cycle and a corresponding sample and hold signal for the load current feedback module.

FIG. 6 shows an embodiment of a pulse signal generator 21 which provides a pulse modulator clock signal output 19 to the load drive section 4 and a corresponding sample-and-hold output signal 20 for the load current feedback module 6. The pulse modulator clock input may be derived from either the microprocessor 1 or an ASIC 91 with a defined frequency and duty cycle. The frequency and duty cycle may be programmed by changing data values held within registers of the microprocessor 1 or by timing synchronisation pulses within the ASIC 91 to enable the illumination system 100 to vary its frequency or duty cycle according to the in tended application. An application brief from Agilent Technologies entitled PULSED OPERATING RANGES FOR ALINGAP LEDS VS PROJECTED LONG TERM LIGHT OUTPUT PERFORMANCE recommends typical duty cycle ratios for common LED-based applications. By utilising one or more output pins located on the microprocessor 1 a highly stable duty cycle and frequency can be achieved which in turn enables precise control of colour synchronisation and therefore CCT and CRI. Additional advantages are a reduction in external component requirements and the ability to change the frequency and duty cycle from software operating on the microprocessor 1.

In general the illumination control system will be operated in a non-continuous pulse mode of operation that will provide current to the LED loads 15 through the load drive section 4. In practice the load current feedback circuits will benefit from amelioration of transient effects in the sensed current. In this embodiment this is achieved using a sample and hold circuit to ensure that the pulse modulated colour synchronised current feedback control signal is maintained during a time period when the Load LEDs are not energised. Without such a circuit, the control system is likely to see transient switching voltages which could result in unsettled drive currents through the loads 15 producing variations in the intensity of the LED light output. A delay is advantageously added to reduce the effect of the initial switching transient.

An inverted and time delayed clock signal relative to the pulse modulator clock signal 19 is thus derived. The sample and hold output signal 20 and clock output signal 19 can be created using NPN transistor Q1 and resistor R2 to invert the pulse modulator clock signal input from a microprocessor 1 or ASIC 91. The inverted signal is buffered and inverted by the dual input NAND gate (U1*a*) with its output connected directly to both inputs of NANDgate (UIc) and also to one of the inputs of NAND gate (U1*b*) and to the other input of the NAND gate (U1*b*) via resistor (R3) capacitor (C1) network. The resistor capacitor (RC) network provides a time delay according to a well known formula and typical values of R3 is 68 kOhms and C1 is 1 nF which provides a time constant of around 68 microseconds. The signal is then inverted and delayed again by U1*c* and the RC network R4 and C2 with a final inversion by NANDgate (U1*d*) to create the pulse modulator clock signal output 19 that represents the ON portion of the duty cycle in FIG. 3. To those of skill in the art, selection of appropriate component values can be performed to accommodate values of maximum and minimum desired values of modulation signal frequency. Equally, alternative circuits to perform the requisite function could readily be designed the skilled person.

This technique is also applicable to the other feedback circuits within the system such as the colour feedback circuit.

Figure 7:
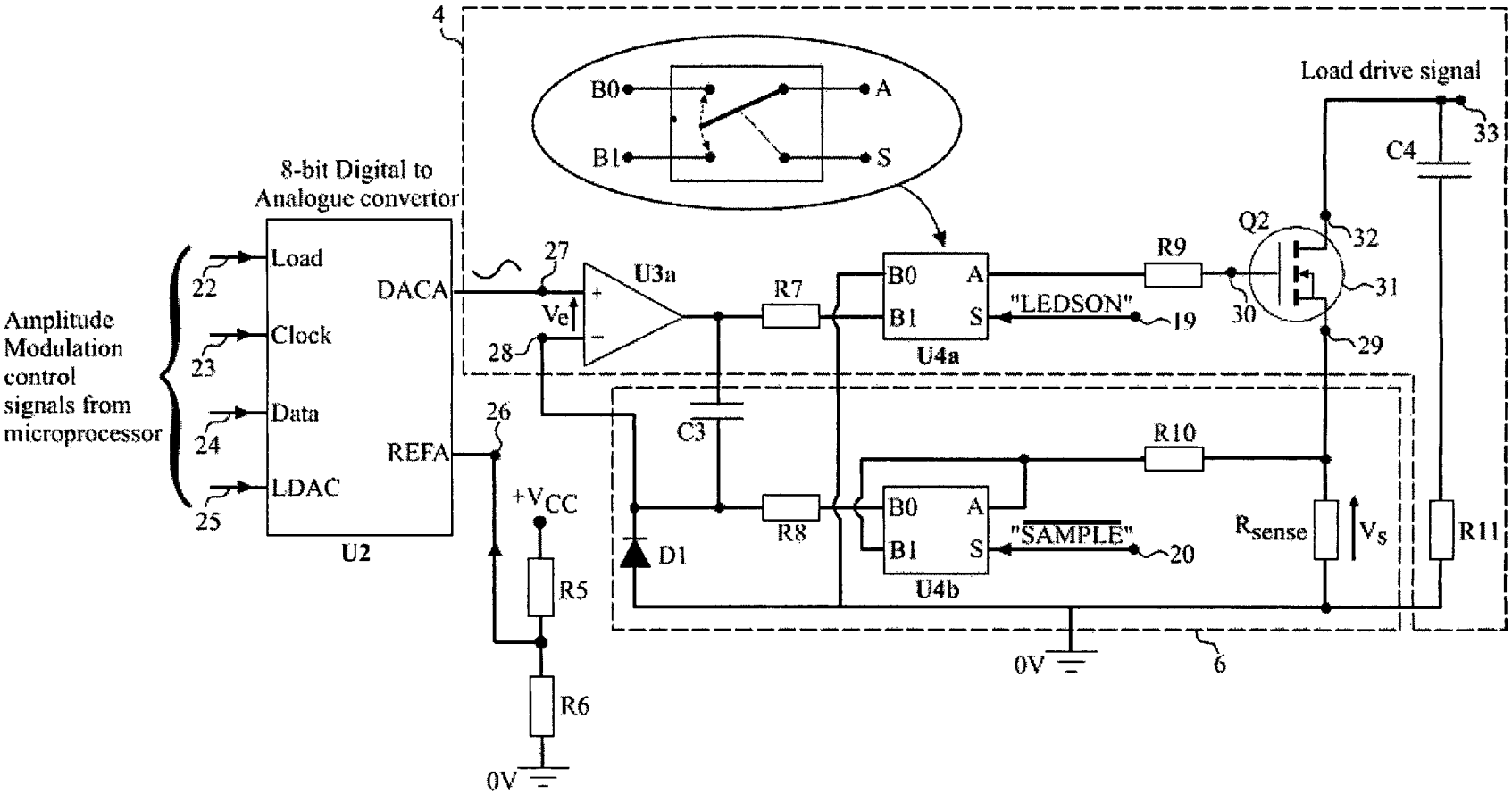
FIG. 7 is a circuit schematic of one embodiment of a pulse modulated colour synchronisation load drive section and a load current feedback module.

FIG. 7 shows the electrical schematic of an embodiment of the load drive section 4 with a load current feedback module 6 whereby a pulse modulated colour synchronised control signal 30 is formed to drive a voltage controlled current source or load driver (31), such as an n-channel MOSFET through a differential amplifier (U3*a*) and analogue switching arrangement (U4*a*, U4*b*). The pulse modulated colour synchronised control signal is created by combining the amplitude modulated control signal 27 using the output of a Digital to Analogue Converter (DAC) U2 and the current feedback control signal is generated using a sense resistor, which is consequently pulse modulated by employing an analogue switching network using the pulse modulator clock signal outputs representing the time periods Ton (19) and Toff (20).

An exemplary DAC is the 14 pin TLC5620 with serial programming interface available from Texas Instruments Incorporated, Dallas Tex., USA. In the current embodiment the DAC is used to generate an amplitude modulated control signal 27 in the form of a voltage output, which is created as a proportion of the DAC$^3$s input reference voltage 26 using an 8-bit data register representing one of 256 different voltage levels between ground and the DAC's reference voltage input. Therefore, by selecting the appropriate value to be stored in the DAC's data register an amplitude (or voltage) of the pulse modulated colour synchronised control signal 30 can be altered accordingly. The DAC's input reference voltage 26 may be generated using a standard voltage divider arrangement containing two resistors R5 and R6 in series between the logic supply voltage and Ground. A typical value for R5 and R6 is 2 k2 Ohms, which provides a DAC input reference voltage 26 of approximately 50% of the logic supply voltage, or 2.5 volts. From the foregoing description it will be appreciated that the DAC's input reference voltage 26 may be provided using alternative techniques.

Figure 8:
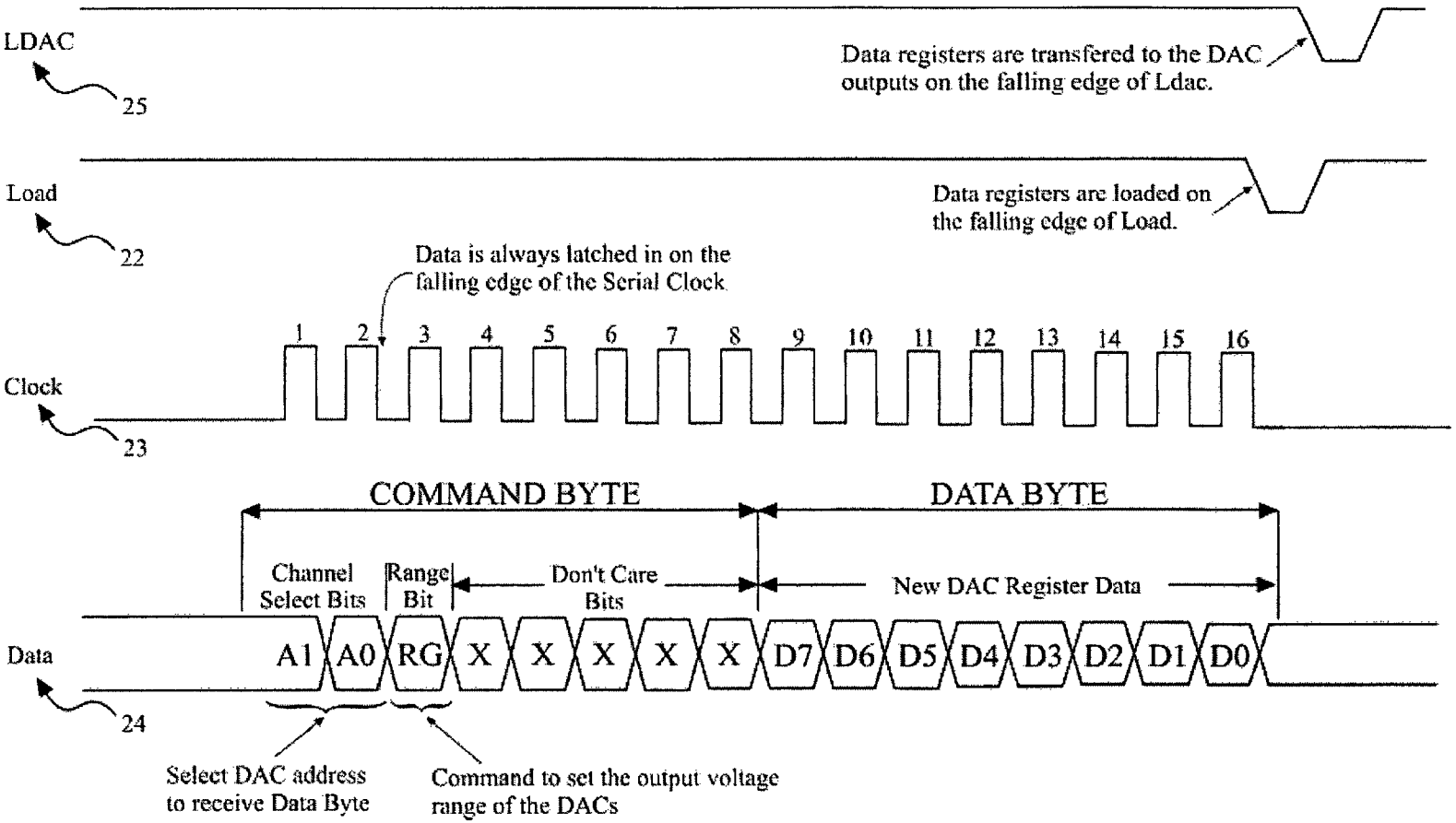
FIG. 8 is a timing diagram illustrating the Idac, load, clock and serial data input control signals required to program a quadruple packaged digital to analogue converter.

The amplitude modulated control signal 27 output is modified by programming the DAC (U2) using a serial interface which is connected to a microprocessor 1 or ASIC 91. To program the DAC with a new output voltage the microprocessor or ASIC sets the DAC Load control line 22 high and then clocks in a command byte followed by a data byte on the DAC Data line 24. Once all the bits have been clocked in, the DAC load control line is pulsed low to transfer the data from the serial input register to the selected DAC data register. When the DAC LDAC control line 25 is set high during serial programming and then pulsed low the DAC data register value is transferred to the DAC output directly. The DAC LDAC control line 25 enables each of the four DACs outputs to be updated simultaneously enabling precise synchronisation of all DAC output channels. The command and data bytes are clocked into the DAC (U2) on the falling edge of the DAC clock line 23 provided by either a microprocessor or ASIC. FIG. 8 is a timing diagram illustrating the sequence for programming the DAC, where the command bits are set to instruct to write the data contained within the data byte to the DAC determined by the channel select bits A0 and A1. The range bit RG controls the DAC output range. When RING is set low, the output range is between the applied reference voltage and GND, and when RING is set high, the range is between twice the reference voltage and GND.

Referring to FIG. 7, the amplitude modulated control signal voltage is fed to a non-inverting amplifier (U3*a*) configured to provide a continuous differential output voltage generated by the voltage difference between the amplitude-modulated control signal voltage 27 and the current feedback control signal voltage 28. The current feedback control signal voltage is generated by a load feedback current sensor 14 in the form of a sense resistor (Rsense) used to measure the current flowing from a power source (+Vdd) through the load 15 and the load driver MOSFET 31 to GND. The sense resistor may be connected between the source terminal of the load driver MOSFET and ground to generate a small voltage (Vs) which is proportional to the load current that flows thorough the load 15. A low value is preferred for Rsense to minimise dissipation and the resistor commonly comprises a discrete metallic resistor with zero temperature coefficient such as manganin or constantin. The sense resistor may comprise a portion of track on the Printed Circuit Board (PCB).

A pulse modulated colour synchronised control signal 30 is created by connecting the output voltage from the differential operational amplifier (U3*a*) stage to the input (B1) of a two-channel, single-pole double-throw analogue switch (U4*a*) through a resistor (R13). The second input (DO) of the analogue switch (U4*a*) is connected directly to circuit ground while the output (A) of the analogue switch (U4*a*) is connected to the gate electrode 30 of the load driver MOSFET 31 through a coupling resistor R9. The control input (S) of the analogue switch (U4*a*) is connected to the pulse modulator clock signal output 19 which connects the appropriate input DO or D1 of the analogue switch (U4*a*) to the output (A) according to the logic level 0 or 1 of the pulse modulator clock output signal 19 respectively. During the ON period Ton, of the pulse modulator clock output signal 19 the analogue switch (U4*a*) output (A) is connected to the coupling resistor (R9) and charges the capacitor (C3) which produces a voltage potential proportional to the output voltage of the differential operational amplifier (U3*a*). However, during the off period, Toff, the analogue switch (U4*a*) output (A) is connected to circuit ground and ensures that the load driver MOSFET 31 does not allow current to pass through the load 15. The voltage potential across the capacitor (C3) remains stable and does not discharge during the time period, Toff, as the inputs D1 and BO of the analogue switches U4*a* and U4*b* become high impedance ensuring little or no current discharge occurs.

During the off time period, Toff, of the sample-and-hold output signal 20 the input DO of the analogue switch (U4*b*) is connected to output (A) and hence to the coupling resistor (RIO) enabling the voltage potential (Vs) across the sense resistor (Rsense) or current feedback control signal voltage 28 to appear at the negative input of the operational amplifier (U3*a*). A protection diode (D1) is used to protect the operational amplifier (U3*a*) from negative voltage spikes that may occur during a failure of the microprocessor 1 or ASIC 91. Accordingly, during the on time, Ton, of the sample-and-hold output signal 20 the input (D1) of the analogue switch (U4*b*) is connected to output (A) leaving a high impedance state at the input (DO). The capacitor (C3) ensures that a voltage is maintained during the timing period, Toff, of the pulsed modulated colour synchronised control signal and therefore does not require a large transition current through the load driver MOSFET when entering the timing period, Ton, thus ensuring the current through the load 15 is stable.

A Zobel filter is present across the load drive signal 33 and the circuit ground in the form of resistor (RI I) and capacitor (C4) in series. The presence of a Zobel filter ensures that the load 15 appears resistive at high frequencies and helps to ensure oscillation is attenuated at high frequencies. Typical values for the resistor (RI 1) in 10 Ohms and capacitor (C4) is 10 nanoFarad.

Figure 9:
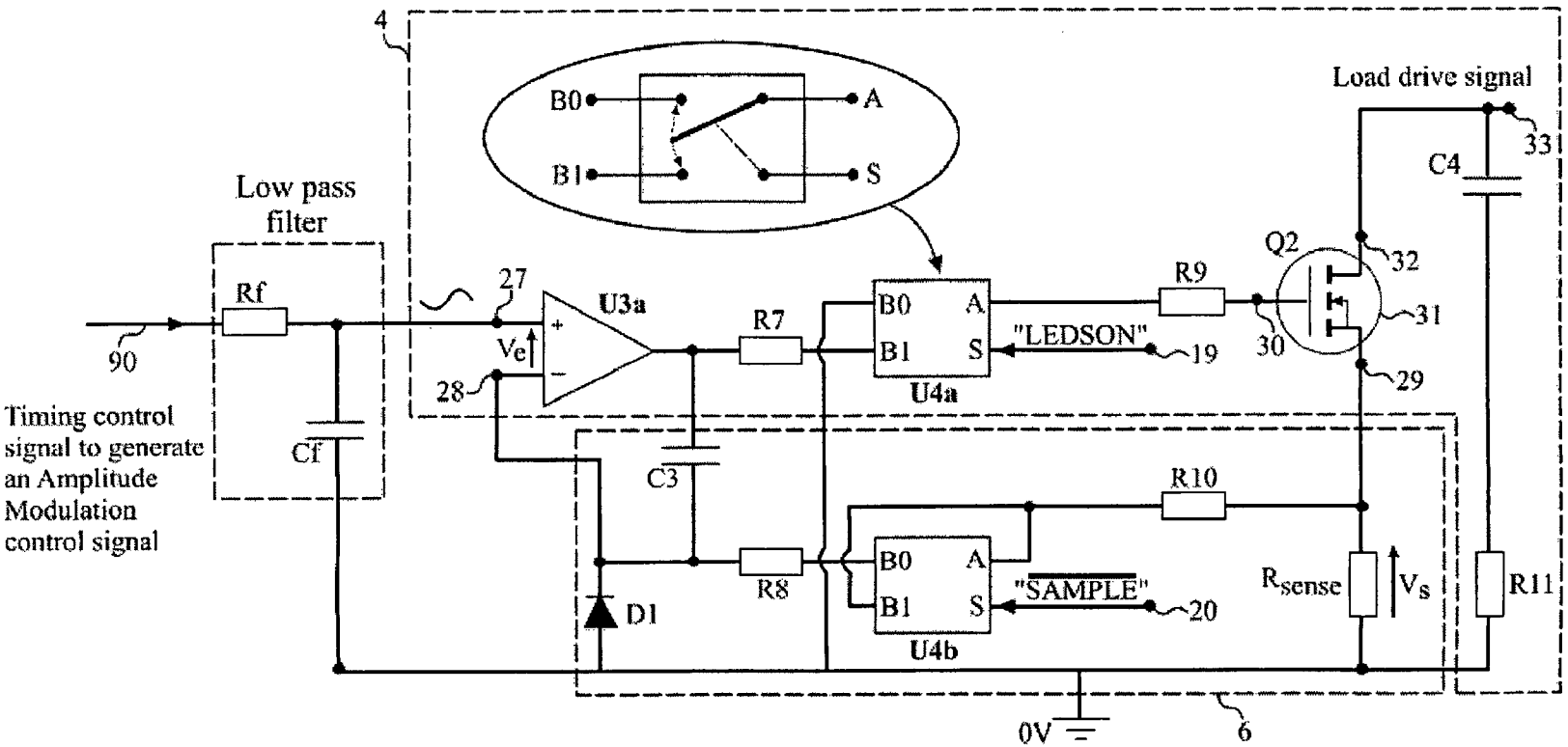
FIG. 9 is a circuit schematic of one alternative embodiment of a pulse-modulated colour synchronisation load drive section and a load current feedback module.

In one alternative embodiment of the load drive section 4 and the load current feedback module 6 shown in FIG. 9, the continuous amplitude modulated control signal 27 is generated by combining two timing signals (one timer represents frequency and the other duty cycle) to form a timing control signal 90 from a microprocessor 1 or ASIC 91. The timing control signal is then integrated through a low pass filter in the form of a resistor/capacitor network. The foregoing embodiment has considerable advantages in practice as the DAC uses low cost passive components and the DAC resolution is software-configurable. Alternatively, the timing control signal 90 may be generated by a dedicated PWM timer within the microprocessor I or ASIC 91 and produces continuous output voltage with an amplitude resolution proportional to the resolution of the input timing control signal 90. Similar DAC conversion techniques are well known to those skilled in the art.

Figure 10:
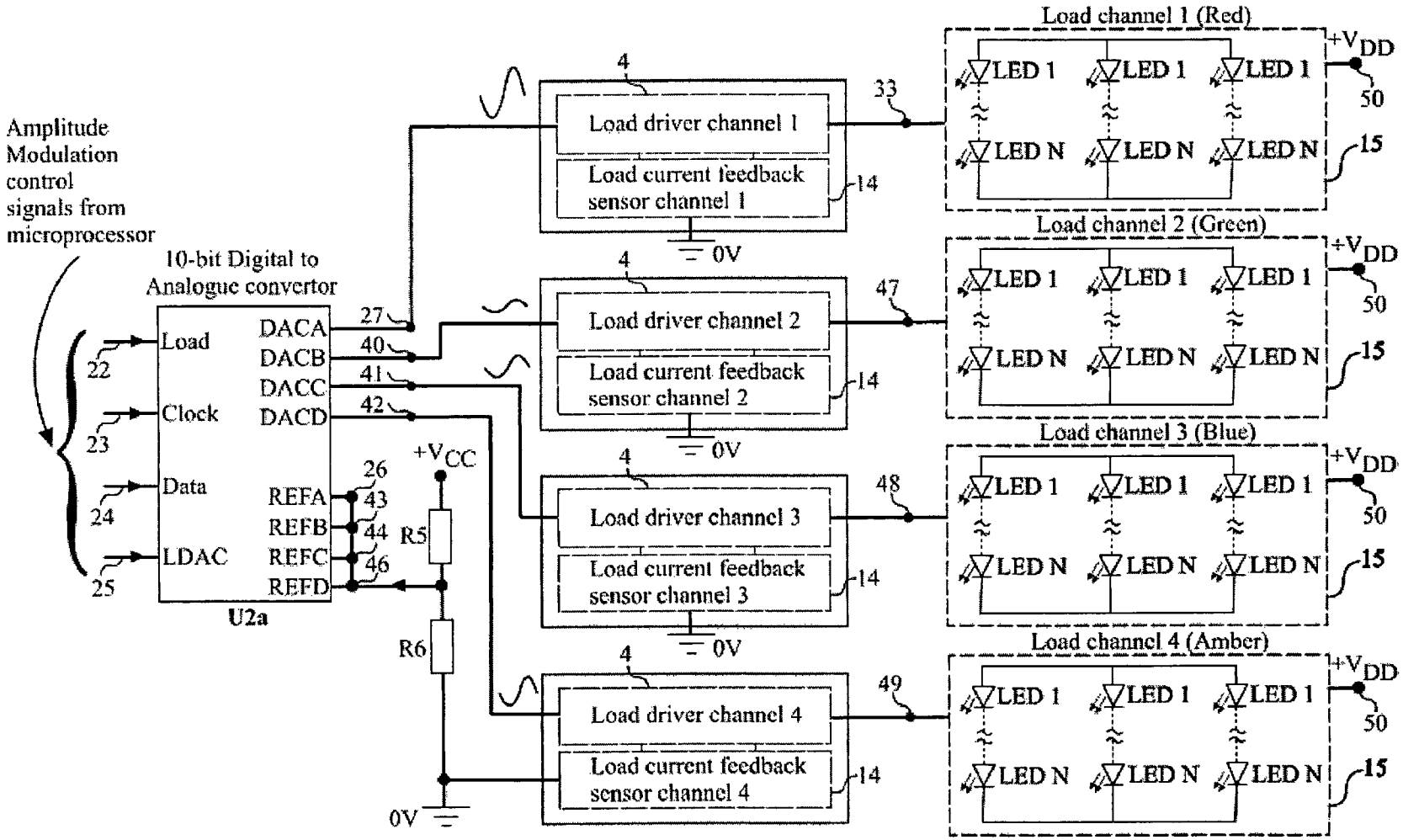
FIG. 10 is a circuit schematic of a further alternative embodiment of a pulse-modulated colour synchronisation load drive section and a load current feedback module for four colour channels.
Figure 11:
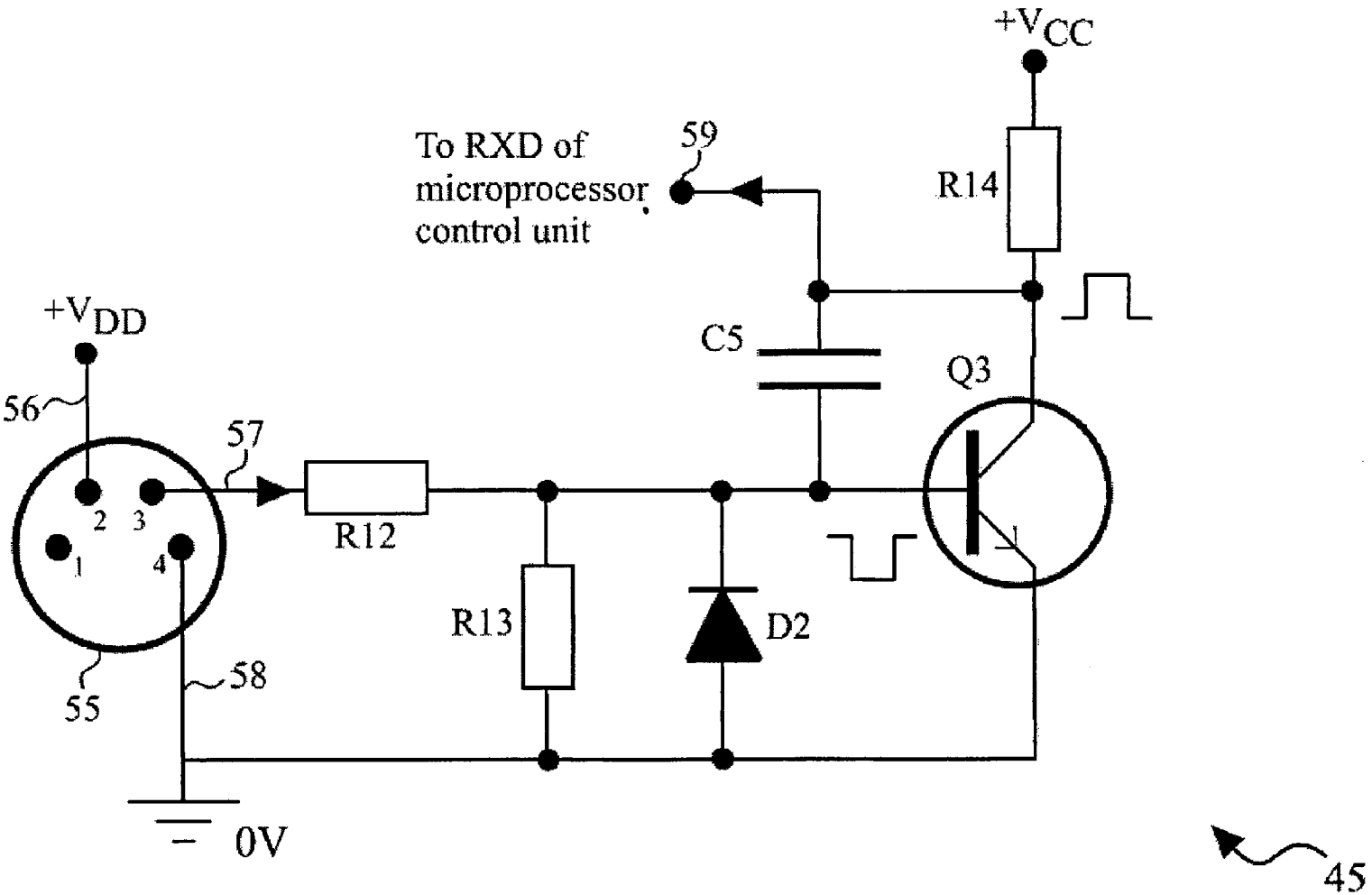
FIG. 11 is a circuit schematic of an embodiment of a communications module for use with embodiments of the present invention.

In yet another separate embodiment of the load drive section 4 shown in FIG. 10 up to 4 separate load driver 4 and four separate load current feedback sensor 14 channels can be are used to invert the serial line data input 57 and slow down the transistor operation. Typical values for capacitor CS and resistor R14 are 100 pF and 22 Kohms respectively.

FIG. 21 shows a lighting arrangement 1010 in accordance with an embodiment of the present invention. A fluorescent tube 1012 is shown arranged in traditional fashion between a reflector 1036 (shown in section) and a diffuser 1014. Light output from the tube passes through the diffuser either directly or via the reflector which is typically shaped and arranged to minimise the amount of "wasted" light.

However, such fluorescent tubes deteriorate with age and, to counter this, a feedback circuit 1020 and six LEDs 1022-1032 are provided to compensate. The diffuser 1014 is provided with a colour sensor 1016 which detects light that has been totally internally reflected within the diffuser. This light will be representative of the light passing through the diffuser and so the output of the sensor 1016 provides a colour feedback signal to the feedback control circuit 1020 via signal line 1018.

The feedback control circuit is arranged to respond to the output of the colour sensor 1016 to control the light issuing from the fixture. To this end the circuit 1020 is connected via line 1034 to six amber LEDs 1022, 1024, 1026, 1028, 1030, 1032 which are mounted in the reflector 1036. Because of the nature of the deterioration of fluorescent tubes, adding some amber light provides compensation for the aging process. As the tube 1012 deteriorates still further, a greater amount of light will be provided by the LEDs to compensate. The closed loop feedback provided by the colour sensor 1016, feedback control circuit 1020 and the LEDs allows at least one colour parameter (for example colour temperature) to be consistently maintained.

The fluorescent tube 1012 may be arranged to be separately removable since the lifetime of such tubes is typically 1000 hours while the lifetime of LEDs is typically 10000 hours. Alternatively, since LEDs are comparatively cheap, they could be incorporated with the tube and discarded when the tube is renewed.

While the colour sensor 1016 is shown as sensing the output from the whole fixture, i.e. the fluorescent tube and the LEDs, it is possible for the sensor to be arranged to detect only the output from the fluorescent tube.

While this embodiment has been described as providing compensation for the aging of the fluorescent tube, it should be noted that it could equally be used to set a desired characteristic, such as colour temperature, for a tube of any age. Since fluorescent tubes are currently provided in various colour temperatures for various purposes, this would allow manufacturers and dealers in fluorescent tubes to reduce their inventory with attendant reduction in cost.

Moreover, this embodiment of the invention may equally be applied to other non-LED sources of light that deteriorate with age or which would benefit from the ability to provide custom colour features such as incandescent lamps.

FIG. 22 shows another embodiment 1100 of the present invention that exploits the total internal reflection of light within a diffuser, lens or cover. The control circuitry has been omitted for clarity. The embodiment may preferably be a headlamp for a car but this aspect of the invention is applicable to a wide range of lighting fixtures.

A circuit board 1102 carries a number of LEDs of which five 1104, 1106,1108,1110 and 1112 are shown. Light from these LEDs passes through a cover 1114 which may be a lens, diffuser etc. constructed from glass or plastics. By the nature of such an arrangement, some of the light incident upon the cover 1114 will be totally internally reflected within the cover as depicted by the zigzag lines. A portion of this totally internally reflected light will impinge upon an optical sensor 1116 mounted somewhere on the periphery of the cover.

The sensor 1116 could be a colour sensor as used in the embodiment shown in the previous figure or it might simply be an intensity sensor an required by the following embodiment. By utilising such as sensor, the collective output of a large number of LEDs may be sensed using a single sensor. This has the benefit over mounting one or more sensors on the circuit board of sensing the entire light output and will not be distorted by the performance (or otherwise~of individual LEDs.

FIG. 23 shows a diagrammatic graph of LED light intensity 1202 and drive current 1204 over time.

Imagine that light intensity 1202 is generated in response to current 1204 towards the left hand side of the graph. In the case of a car headlamp, for example, there is a minimum acceptable intensity value determined by the regulatory authorities. In other applications there will be a minimum specification of light output and this value is illustrated by the horizontal broken line 1206.

After a long usage time the output of the LED will deteriorate as illustrated by the downward turn of curve 1202 at time A. At time B the intensity of the LED output falls below specification. One possibility here would be to detect this and light a warning light on the dashboard of the car (or somewhere else on another, non-automotive, light fitting) to inform the driver that his or her lighting unit needs to be replaced. However, this would quite likely be ignored as the deterioration in intensity would probably not be discernable to the driver.

In the present embodiment, this is addressed by increasing the current drive provided to the LED at time B to cause the light intensity to follow the dot-dash line 1208 (i.e. continue at or above the minimum output level). As a consequence of this the LED will fail catastrophically at time C as shown by the line 1210. The advantages are that the lifetime of the LED is extended beyond that at which it fails to perform to specification and the catastrophic failure ensures that the driver or other user has to replace the LED, lighting unit or fixture and cannot continue to operate a failing unit with the attendant safety implications.

Conventional LED devices usually emit a radiant light pattern at large beam angles that restricts their use for applications where a defined beam output is required. FIG. 25 shows a LED beam collimating system 200 that provides a degree of illumination beam output control to convert the light output from a LED source 220 to a more usable light source with collimated light output characteristics.

As shown a light shaping diffuser 210 can be placed directly in front of the LED light source 220 containing LED's of different wavelength characteristics 230, 232, 234, 236 to enable the light output of the illumination system to be spatially invariant in terms of colour, colour temperature and colour rendering index properties.

The light shaping diffuser 210 could also be utilised to change the beam pattern of the LED beam collimating system 200 from a typical Gaussian beam output to a square, elliptical, line or some other required beam profile.

FIG. 26 shows how a multi-element LED beam collimating system can be utilised to convert one or more wide beam angle LED's to a narrow angle light source providing a highly collimated LED beam output by utilising a combination of multi-element micro refractive elements 300 aligned to the LED dies contained within the LED source 320 and a light shaping diffusing element 340. Combining a multi-element micro refractive optic and a light shaping diffuser enables a compact, lightweight highly collimated LED source to be obtained.

Referring now to FIG. 27, a further embodiment of the invention is shown incorporating a configuration whereby a non-imaging diffractive 400 and an imaging element 420 are combined to provide a highly collimated beam output from the LED source 430.

The non-imaging element 400 could consist of a micro diffractive optical system or a holographic optical element to concentrate the light emitted from the LED source 430 without maintaining any of the spatial characteristics of the LED's 440, 442, 444, 446. The second imaging element 420 could consist of a lens and provides enhanced collimation and beam control.

This arrangement enable the use of the LED light source 430 in a large number of lighting application such as image projection systems, whilst maintaining high light efficiency.

FIG. 28 shows a light projection arrangement 500 in accordance with an embodiment of the present invention. A LED source 510 is shown with an arrangement containing an array of one or more LED emitters 520, 522, 524, 526. The light output from the LED source 510 passes through a multi-element light emitting diode beam collimating system 530 into an aperture arrangement 540 that can contain an object that can be projected using a series of imaging lenses 550, 552, 554 that can be continuously adjusted to provide a projected image of the aperture or object placed at the aperture with a continuously variable beam profile output. The imaging lenses 550, 552, 554, may contain a combination of aspheric or spherical surfaces to provide the required imaging properties.

This arrangement utilises the advantages of non-imaging and imaging optics to provide a highly efficient compact, low cost, low weight lighting projection system.

FIG. 29 shows another embodiment of the invention whereby a plurality of lighting fixtures 620 are controlled and coordinated utilising a system 600 through the use of a Local Area Network (LAN), a Wide Area Network (WAN) 610 or the Internet utilising 630 TCP/IP protocols.

This communication technique provides a considerable advantage as standard IT infrastructures may be utilised to control a large network of lighting fixtures in a variety of topologies with low cost.

For example, one controller 600 could be connected via the Internet 630 to a remote site located anywhere in the World, shown as 640 & 650, and control the lighting scene automatically and communicate lighting fixture control and diagnostic information in real time mode.

The various aspects of the invention described herein are applicable, unless the context indicates otherwise, to PAM driving techniques and, albeit with possible reduction in performance, to PWM, PFM and other non-PAM driving techniques.

The present disclosure extends to any novel feature or combination of features disclosed herein whether express or implied and to any generalisation thereof.

The invention claimed is:

1. A lighting fixture comprising at least two emitters having different wavelength characteristics and a cover consisting of a diffuser through which light from said at least two emitters travels when they are activated, an optical sensor arranged to sample the combined output of said at least two emitters by detecting light that has been totally internally reflected in the cover, wherein the optical sensor is directly connected to said diffuser, and the optical sensor comprises a sensor responsive to color and intensity of the internally reflected light.

2. A lighting fixture as claimed in claim 1 wherein the emitters comprise LEDs.

3. A lighting fixture as claimed in claim 1 further comprising a feedback circuit responsive to the output of the optical sensor to control the emitters.

4. A lighting fixture as claimed in claim 1 further comprising a lighting control circuit for pulsed driving of the emitters and receiving optical output information from the sensor, the control circuit comprising means for receiving information concerning ambient light output when none of the emitters are activated.

5. A lighting fixture as claimed in claim 4 further comprising a feedback circuit for controlling the drive to the emitters in response to the actuated light output and ambient light.

6. A lighting fixture as claimed in claim 1 further comprising a lighting control circuit for driving said at least two emitters and for receiving a signal from the sensor, the control circuit comprising means for altering the amount of drive applied to said at least two emitters in response to color and intensity information derived from the sensor.

7. A lighting fixture as claimed in claim 1 wherein the emitters comprise LEDs of at least two different types, each type having a different characteristic wavelength, and the lighting fixture further comprises a lighting control circuit for driving the two different types of LEDs to desired light intensities during coincident drive periods wherein means are provided to alter at least one of duration and repetition frequency of the drive period.

8. A lighting fixture as claimed in claim 7, wherein the drive periods start in response to an external signal.

9. A lighting fixture as claimed in claim 7, further comprising a plurality of inorganic LEDs.

10. A lighting fixture as claimed in claim 1, wherein the emitters comprise LEDs and the lighting fixture further comprises a drive circuit for the LEDs comprising power control means for controlling the amount of power supplied to at least one LED, means for measuring the intensity of the light emitted by said at least one LED, the power control means being responsive to the intensity of the light emitted wherein the power control means is arranged to drive said at least one LED at a power greater than specified.

11. A lighting fixture as claimed in claim 1 wherein the emitters comprise LEDs and a temperature sensor is provided mounted in proximity to an LED to track the junction temperature thereof.

12. A lighting fixture as claimed in claim 11 further comprising a feedback circuit for ensuring that the power supplied to the LED is, at least in part, responsive to the junction temperature thereof.

13. A lighting fixture as claimed in claim 11, wherein the temperature sensor is mounted in the same package as the LED.

14. A lighting fixture as claimed in claim 1 further comprising a lighting control circuit for intermittently driving the emitters and receiving feedback information from at least one feedback sensor, the lighting control circuit comprising means for ameliorating transient effects on the output of the feedback sensor.

15. A lighting fixture as claimed in claim 14, wherein the means for eliminating transient effects comprises a sample and hold circuit.

16. A lighting fixture as claimed in claim 14 wherein the means for eliminating transient effects include a delay between the actuation of at least one of the emitters and the receiving of feedback information from the at least one feedback sensor.

17. A lighting fixture as claimed in claim 1 wherein the emitters comprise LEDs and the lighting fixture further comprises a lighting control circuit for driving at least one LED and for receiving color information from the sensor, the sensor being located to receive light from at least one other light source which does not comprise an LED, and the lighting control unit comprising means for driving said at least one LED in response to the color information received from the sensor regarding the light from the at least another light source.

18. A lighting fixture as claimed in claim 17 wherein the means for driving said at least one LED is further responsive to color information received from the sensor which color information is derived from light generated by both said at least one LED and said at least one other light source.

19. A lighting fixture as claimed in claim 17 wherein said another light source comprises a fluorescent light fitting.

* * * * *